US010267064B2

(12) United States Patent
Choy et al.

(10) Patent No.: US 10,267,064 B2
(45) Date of Patent: Apr. 23, 2019

(54) LOCK WITH LINEARLY OPERATING LATCH

(71) Applicants: Wai-Ho Choy, Danbury, CT (US); Patrick E. Wind, Darien, CT (US); Kevin Houlihan, North Salem, NY (US); Cheung Yi Lam, Naugatuck, CT (US)

(72) Inventors: Wai-Ho Choy, Danbury, CT (US); Patrick E. Wind, Darien, CT (US); Kevin Houlihan, North Salem, NY (US); Cheung Yi Lam, Naugatuck, CT (US)

(73) Assignee: ZEPHYR LOCK, LLC, Newtown, CT (US)

( * ) Notice: Subject to any disclaimer, the term of this patent is extended or adjusted under 35 U.S.C. 154(b) by 282 days.

(21) Appl. No.: 13/650,456

(22) Filed: Oct. 12, 2012

(65) Prior Publication Data

US 2013/0239629 A1 Sep. 19, 2013

Related U.S. Application Data

(60) Provisional application No. 61/546,425, filed on Oct. 12, 2011, provisional application No. 61/564,847,
(Continued)

(51) Int. Cl.
*E05B 37/00* (2006.01)
*E05B 65/02* (2006.01)
(Continued)

(52) U.S. Cl.
CPC ..... *E05B 65/025* (2013.01); *E05B 17/2003* (2013.01); *E05B 17/2007* (2013.01);
(Continued)

(58) Field of Classification Search
CPC ..... E05B 37/034; E05B 37/025; E05B 37/02; E05B 35/105; E05B 37/0034;
(Continued)

(56) References Cited

U.S. PATENT DOCUMENTS 13,722 A 10/1855 Holmes et al.
214,521 A 4/1879 Ham
(Continued)

FOREIGN PATENT DOCUMENTS

DE 2342574 3/1975
DE 3437563 A1 4/1986
(Continued)

OTHER PUBLICATIONS

International Search Report from PCT/US07/15957 dated Jan. 9, 2008, 1 page.
International Search Report from PCT/US07/03548 mailed Jan. 9, 2008, 1 page.
Written Opinion from PCT/US07/15957 dated Jan. 9, 2008, 5 pages.
Written Opinion from PCT/US2007/003548 mailed Jan. 9, 2008, 7 pages.
(Continued)

*Primary Examiner* — Suzanne L Barrett
*Assistant Examiner* — Morgan McClure
(74) *Attorney, Agent, or Firm* — Cantor Colburn LLP

(57) ABSTRACT

A lock is provided, the lock having: a lock mechanism having a first member and a second member, the first member and the second member each being slidably mounted to a housing of the combination lock, wherein the first member is capable of movement between a first position and a second position and the second member is capable of movement between a first position and a second position and wherein movement of the first member from the first position to the second position causes the second member to move from the first position to the second position; a bolt configured for movement between a locking position and an unlocking position, the bolt preventing the second member from moving from the second position to the first position when the bolt is in the locking position.

18 Claims, 38 Drawing Sheets

Related U.S. Application Data filed on Nov. 29, 2011, provisional application No. 61/565,333, filed on Nov. 30, 2011.

(51) Int. Cl.

| | |
|---|---|
| ***E05B 17/20*** | (2006.01) |
| ***E05B 35/10*** | (2006.01) |
| ***E05B 37/08*** | (2006.01) |
| ***E05B 55/00*** | (2006.01) |
| ***E05B 65/52*** | (2006.01) |
| ***E05C 1/08*** | (2006.01) |
| ***E05C 3/12*** | (2006.01) |
| *E05B 37/02* | (2006.01) |

(52) U.S. Cl.

CPC ..... *E05B 35/105* (2013.01); *E05B 37/00* (2013.01); *E05B 37/0034* (2013.01); *E05B 37/0048* (2013.01); *E05B 37/08* (2013.01); *E05B 55/00* (2013.01); *E05B 65/52* (2013.01); *E05C 1/08* (2013.01); *E05C 3/12* (2013.01); *E05B 37/02* (2013.01); *E05B 37/025* (2013.01); *Y10T 70/5097* (2015.04); *Y10T 70/70* (2015.04); *Y10T 70/735* (2015.04); *Y10T 70/7322* (2015.04); *Y10T 70/8351* (2015.04)

(58) Field of Classification Search

CPC ..... E05B 37/08; E05B 37/00; E05B 65/52; E05B 65/025; E05B 55/00; E05C 1/12; E05C 1/08; E05C 1/10; E05C 1/14; Y10T 70/7322; Y10T 70/70; Y10T 70/8351; Y10T 70/735; Y10T 70/5097

USPC ..... 70/80–83, 110, 130, 131, 133, 134, 141, 70/142, 150, 284, 285; 292/332, 333, 292/334, 335, 163, 164, 170, 169, 169.13, 292/169.14, 140, 146, 150

See application file for complete search history.

(56) References Cited

U.S. PATENT DOCUMENTS 257,725 A 5/1882 Lalor
307,281 A 10/1884 Farrar
558,547 A 4/1896 Burrows, Jr.
781,185 A 1/1905 Campbell
885,559 A 4/1908 Woodward
900,437 A 10/1908 Soley
900,438 A 10/1908 Soley
925,900 A 6/1909 Hansen
930,534 A 8/1909 Cox
1,036,348 A 8/1912 Schmittberger
1,466,489 A 8/1923 Starrett
1,592,405 A * 7/1926 Worley, Jr. et al. ..... 70/81
1,592,406 A 7/1926 Worley, Jr.
1,716,169 A 6/1929 Hart
1,774,783 A * 9/1930 Worley, Jr. et al. ..... 70/82
1,806,031 A 5/1931 Wignos
1,902,547 A 3/1933 Endter
1,923,903 A 8/1933 Albach et al.
2,002,453 A 5/1935 North
2,047,795 A 7/1936 North
2,112,982 A 4/1938 Brauning
2,153,088 A 4/1939 Knell
2,156,874 A 5/1939 Schonitzer
2,217,098 A 10/1940 Brownne
2,518,141 A 8/1950 Hiler
2,567,114 A 9/1951 Linn
2,634,147 A 4/1953 Robertson
2,725,739 A 12/1955 Check
2,795,947 A 6/1957 Peras
2,875,604 A 3/1959 Fohn
2,910,859 A 11/1959 Allen et al.
2,953,011 A 9/1960 Sitler
3,023,600 A 3/1962 Stahl et al.
3,023,602 A 3/1962 Foote et al.
3,031,876 A 5/1962 Foote et al.
3,031,877 A 5/1962 Foote et al.
3,190,089 A 6/1965 Foote et al.
3,237,434 A 3/1966 Jackes et al.
3,325,203 A 6/1967 Moler
3,429,153 A 2/1969 Magyar
3,447,348 A 6/1969 Dauenbaugh
3,451,704 A 6/1969 Cothron
3,691,799 A 9/1972 Hoffmann et al.
3,799,594 A 3/1974 Watermann
3,890,813 A 6/1975 Cothron
3,917,330 A 11/1975 Quantz
4,125,008 A 11/1978 Genest et al.
4,194,377 A 3/1980 Maeda
4,281,525 A 8/1981 Bako
4,395,064 A 7/1983 Bellot et al.
4,414,828 A 11/1983 Takinami et al.
4,438,964 A 3/1984 Peters
4,528,829 A 7/1985 Bert et al.
4,567,741 A 2/1986 Trempala
4,635,454 A 1/1987 Brown
4,648,253 A 3/1987 Imhoff
4,667,990 A 5/1987 Quantz
4,671,548 A 6/1987 Haberle et al.
4,682,483 A 7/1987 Werner
4,706,478 A 11/1987 Swan et al.
4,770,013 A 9/1988 Nakai
4,783,103 A 11/1988 Schlegel
4,838,054 A 6/1989 Weinerman et al.
4,858,456 A 8/1989 McGee, Sr.
4,945,737 A * 8/1990 Hart ..... E05B 55/005 292/167
4,979,384 A 12/1990 Malesko et al.
5,007,261 A 4/1991 Quantz
5,238,274 A 8/1993 Becker et al.
5,372,021 A 12/1994 Smith
5,473,922 A 12/1995 Bair et al.
5,524,944 A 6/1996 Berg
5,611,224 A 3/1997 Weinerman et al.
5,918,916 A * 7/1999 Kajuch ..... 292/163
5,934,120 A 8/1999 Kuo
5,979,198 A 11/1999 Haas-Trober et al.
6,178,792 B1 1/2001 Glazier
6,314,773 B1 11/2001 Miller et al.
6,341,513 B1 1/2002 Chen
6,345,523 B1 2/2002 Kuo
6,401,505 B1 * 6/2002 Kajuch et al. ..... 70/301
6,460,708 B2 10/2002 Dean et al.
6,622,534 B1 9/2003 Miller et al.
6,685,242 B2 2/2004 Furner
6,722,169 B2 4/2004 Segawa
6,733,049 B2 5/2004 Piorkowski et al.
7,131,301 B1 11/2006 Chang
7,178,371 B2 2/2007 Lindstrom
7,269,984 B2 9/2007 Jackson
7,458,239 B1 12/2008 Ma
7,533,551 B1 5/2009 Liu
7,603,881 B2 10/2009 Yukihara et al.
7,836,738 B2 11/2010 Tien et al.
7,946,632 B1 5/2011 Mueller
8,051,691 B2 11/2011 Gallo et al.
8,459,705 B2 6/2013 Suh et al.
8,523,249 B2 9/2013 Hodgin et al.
8,534,100 B2 9/2013 Tsai
2004/0182120 A1 9/2004 Flory et al.
2005/0046198 A1 * 3/2005 Alexander ..... E05B 59/00 292/163
2005/0212301 A1 9/2005 Huang
2005/0218659 A1 10/2005 Geringer et al.
2006/0001275 A1 1/2006 Plett et al.
2006/0150693 A1 7/2006 Houlihan et al.
2006/0185405 A1 8/2006 Middleton
2006/0208499 A1 9/2006 Rusiana
2007/0193318 A1 8/2007 Churchill et al.
2008/0134735 A1 6/2008 Gallo et al.
2008/0196460 A1 8/2008 Houlihan et al.
2008/0209962 A1 9/2008 Peot et al.

(56) References Cited

U.S. PATENT DOCUMENTS

| | | | | |
|---|---|---|---|---|
| 2008/0211239 | A1 | 9/2008 | Keller | |
| 2009/0241619 | A1 | 10/2009 | Kuester et al. | |
| 2010/0117378 | A1 | 5/2010 | Seo et al. | |
| 2010/0213724 | A1 | 8/2010 | Uyeda | |
| 2010/0263418 | A1* | 10/2010 | Moon | 70/107 |
| 2011/0061428 | A1 | 3/2011 | Mikolajczyk et al. | |
| 2012/0013135 | A1* | 1/2012 | Moon | 292/165 |
| 2013/0175811 | A1 | 7/2013 | Hodgin | |
| 2013/0239629 | A1 | 9/2013 | Choy et al. | |
| 2013/0283866 | A1 | 10/2013 | Houlihan et al. | |
| 2014/0167424 | A1 | 6/2014 | Frias | |
| 2015/0035290 | A1 | 2/2015 | Mcgill et al. | |

FOREIGN PATENT DOCUMENTS

| | | |
|---|---|---|
| DE | 102005034833 | 2/2006 |
| EP | 1617024 | 5/2005 |
| GB | 1278129 | 6/1972 |
| JP | 2001-271547 | 5/2001 |
| WO | 2007073800 A1 | 6/2007 |

OTHER PUBLICATIONS

Letter from Christopher C. Boehm to Mr. David Grover or any individuals associated with the prosecution of U.S. Appl. No. 11/774,038 at Calfee, Halter & Griswold, Regarding U.S. Appl. No. 11/774,038. Mailed on Mar. 21, 2011. 2 pages.

Letter from David J. Grover to Mr. Christopher C. Boehm Regarding U.S. Appl. No. 11/774,038. Mailed on Mar. 28, 2011, 2 pages.

Letter from Christopher C. Boehm to Mr. David Grover Regarding U.S. Appl. No. 11/774,038. Mailed Apr. 1, 2011. 2 pages.

Email from David Grover to Christopher C. Boehm regarding U.S. Appl. No. 11/774,038. Sent on Apr. 8, 2011 at 1:04 pm. 4 pages.

Letter from Christopher C. Boehm to Mr. David Grover Regarding U.S. Appl. No. 11/774,038., Mailed on Apr. 29, 2011. 1 page.

Machine Translation for DE 23 42 574.

Machine Translation for EP1617024.

Specification and Drawings for U.S. Appl. No. 12/250,368, filed Oct. 13, 2008.

* cited by examiner

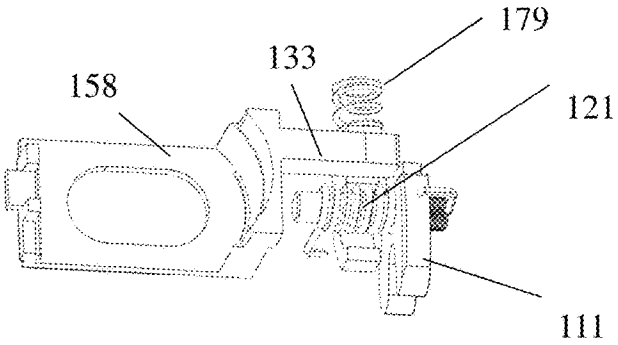
FIG. 25B
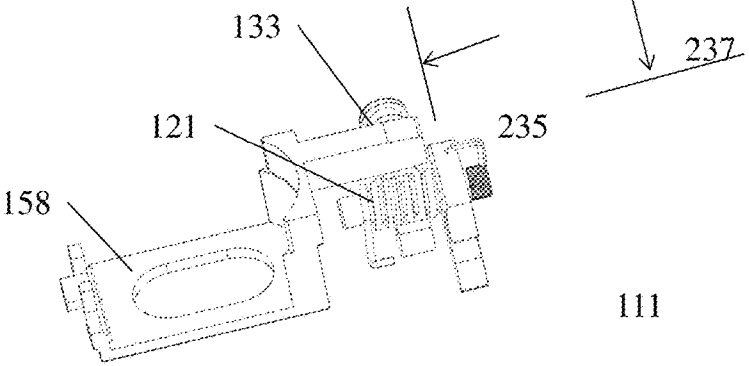
FIG. 25C
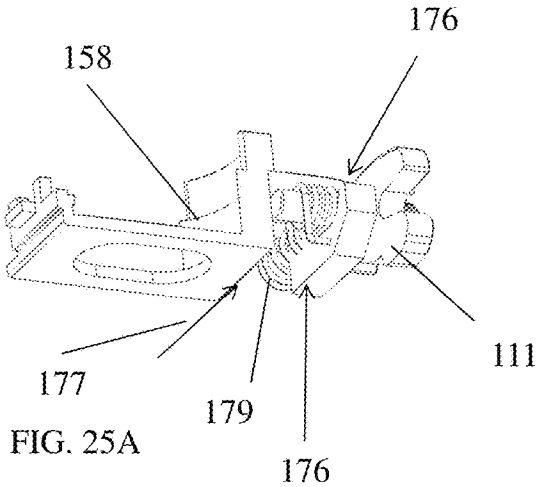
FIG. 25A
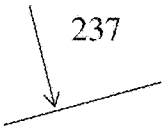
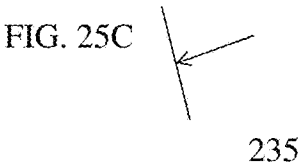

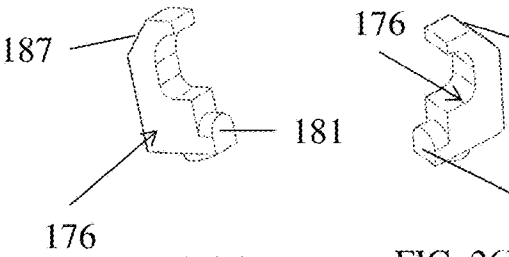
FIG. 26A
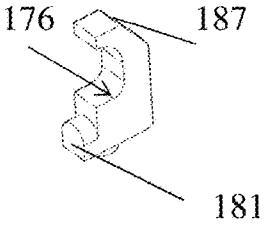
FIG. 26B
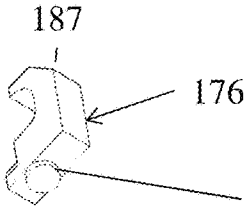
FIG. 26C
FIG. 27A
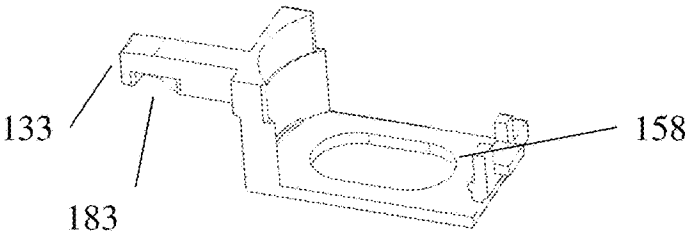
FIG. 27B
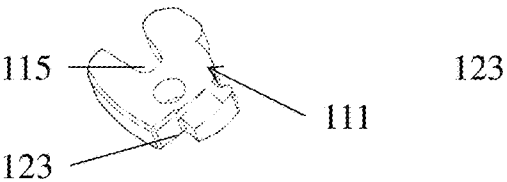
FIG. 28A
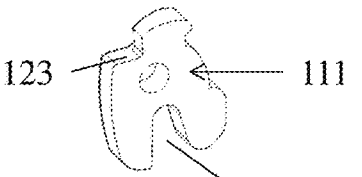
FIG. 28B
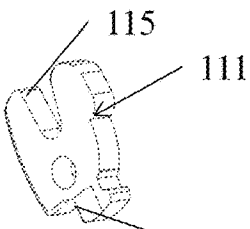
FIG. 28C

LOCK WITH LINEARLY OPERATING LATCH

CROSS REFERENCE TO RELATED APPLICATIONS

This application claims the benefit of the following U.S. Provisional Patent Application Ser. No. 61/546,425 filed Oct. 12, 2011; Ser. No. 61/564,847 filed Nov. 29, 2011 and Ser. No. 61/565,333 filed Nov. 30, 2011, the contents each of which are incorporated herein by reference thereto.

BACKGROUND

This application relates generally to combination locks for lockers.

Combination locks are used to secure or lock the door of lockers, cabinets, toolboxes, desks, and other such enclosures. A low cost solution of such combination locks includes the use of spring bolts that actuate in response to entry of the correct combination. Such spring bolt combination locks eliminate the need for bulky and expensive handle mechanisms.

In many applications, the user of the combination lock changes over time. For instance, lockers in a school are often assigned to one student user for a period of time, such as a school year, and then assigned to another student in a following school year. In this example, the school often times desires to retain the ability to gain entry to the locker without need of the combination. Thus, combination locks are provided with a master key. The master key can actuate the spring bolt to open the lock without the combination. The master key, when used with a push button mechanism, changes the combination of the lock to one of several different pre-assigned combinations.

Examples of such key-controlled combination changing permutation locks are provided in U.S. Pat. Nos. 3,023,600, 3,023,602, 3,031,876, 3,031,877, and 3,190,089 to Foote et al., the contents each of which are incorporated herein by reference thereto.

Prior combination locks have several disadvantages for example, prior locks having a fully retractable bolt have a less than desired bolt throw (e.g., not more than about 0.25 inches). Alternately, some prior locks have been made with longer bolt throws, but do not allow for the complete retraction of the bolt. The prior locks also provide a less than a desired number of available pre-assigned combinations. Moreover, such combination locks do not avoid unauthorized entry when used in situations where the frame of the locker is capable of being bent outwardly enough to allow the bolt to no longer be engaged in the frame thus allowing the locker to be opened.

Accordingly, it is desirable to provide a combination lock that addresses the aforementioned deficiencies.

SUMMARY

In accordance with an exemplary embodiment of the present invention a lock is provided, the lock having a lock mechanism having a first member and a second member, the first member and the second member each being slidably mounted to a housing of the combination lock, wherein the first member is capable of movement between a first position and a second position and the second member is capable of movement between a first position and a second position and wherein movement of the first member from the first position to the second position causes the second member to move from the first position to the second position; a bolt configured for movement between a locking position and an unlocking position, the bolt preventing the second member from moving from the second position to the first position when the bolt is in the locking position.

In accordance with another exemplary embodiment of the present invention a locker is provided, the locker, having a door pivotally mounted to a frame of the locker; a striker plate secured to the frame; a combination lock mounted to the door, the combination lock comprising: a lock mechanism having a first member and a second member, the first member and the second member each being slidably mounted to a housing of the combination lock, wherein the first member is capable of movement between a first position and a second position and the second member is capable of movement between a first position and a second position and wherein movement of the first member from the first position to the second position causes the second member to move from the first position to the second position; a bolt configured for movement between a locking position and an unlocking position, the bolt preventing the second member from moving from the second position to the first position when the bolt is in the locking position.

In another exemplary embodiment, a method of locking a lock is provided, the method including the steps of: biasing a first member of a lock mechanism into a first position; coupling the first member to a second member of the lock mechanism, wherein movement of the first member from the first position to a second position will cause the second member to move from a first position to a second position wherein a portion of the second mechanism will be extended from a housing of the lock; preventing the second member to move from the second position to the first position by moving a feature of a bolt into a blocking position with respect to a surface of the second member when the second member is in the second position.

In another exemplary embodiment, a combination lock is provided, the combination lock having: a rotary latch configured for rotation between a locked position and an unlocked position, the rotary latch being rotatably secured to a housing of the combination lock, wherein the rotary latch rotates in a first plane; a bolt configured for movement between a first position and a second position along a second plane the second plane being oriented at a different location than the first plane, the bolt engaging the rotary latch in the first position such that rotation of the rotary latch from the locked position to the unlocked position is prevented, wherein the bolt is movably mounted to the housing.

The above-described and other features and advantages of the present invention will be appreciated and understood by those skilled in the art from the following detailed description, drawings, and appended claims.

BRIEF DESCRIPTION OF THE DRAWINGS

FIGS. 22-28C illustrate still yet another alternative exemplary embodiment of the present invention;

DESCRIPTION OF THE PREFERRED EMBODIMENT

Figure 1:
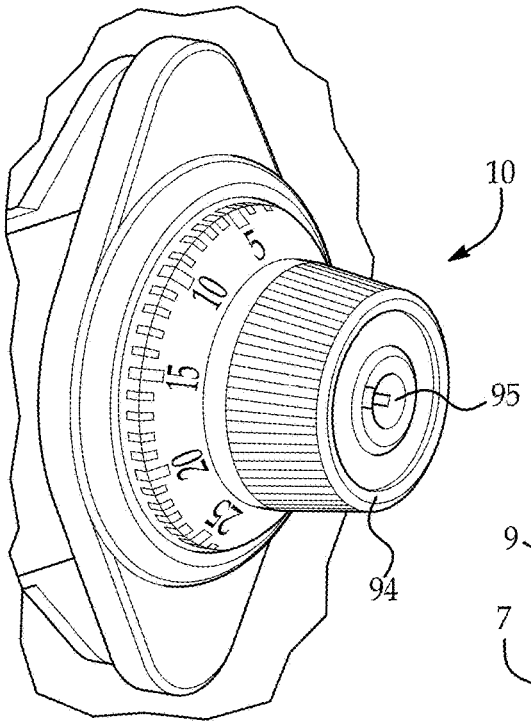
FIG. 1 is a perspective view of a portion of a lock in accordance with an embodiment.
Figure 1A:
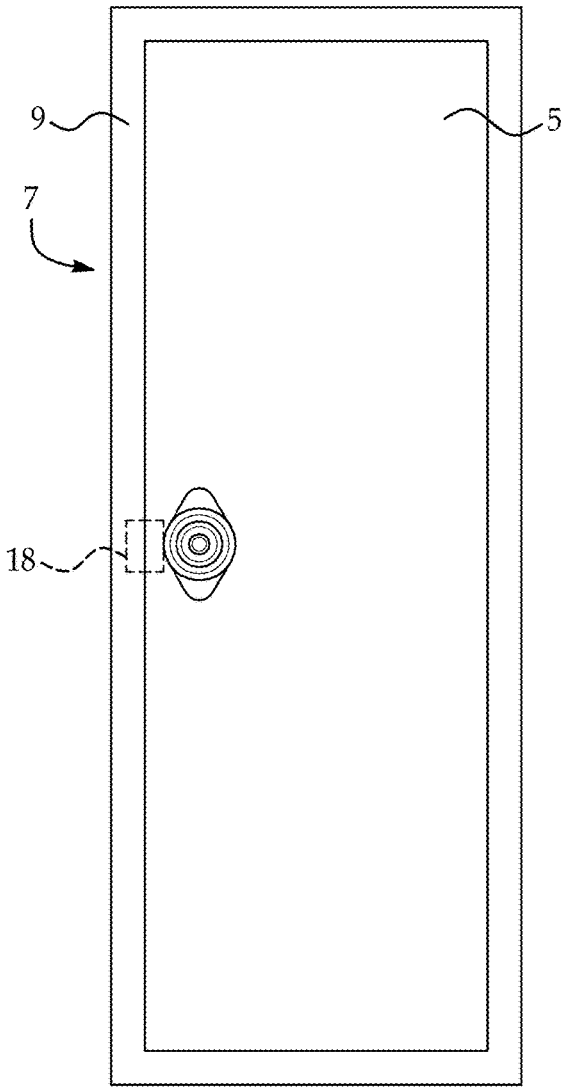
FIG. 1A illustrates the lock assembled in a door of a locker.

Reference is made to the following U.S. Provisional Patent Application Ser. No. 60/865,097 filed Nov. 9, 2006 and U.S. patent application Ser. No. 11/938,002 filed Nov. 9, 2007 the contents each of which are incorporated herein by reference thereto.

Reference is also made to the following U.S. patent application Ser. No. 12/250,368 filed Oct. 13, 2008, which claims the benefit of U.S. Provisional Patent Application Ser. No. 60/979,606 filed Oct. 12, 2007, the contents each of which are incorporated herein by reference thereto.

Referring now to the FIGS., an exemplary embodiment of the present invention is illustrated. Here an improved combination changing permutation lock 10 is illustrated. Lock 10 is configured to be assembled in a door 5 of a locker 7. It should be recognized that use of lock 10 is not limited to lockers, but also finds use in other applications such as, but not limited to cabinets, toolboxes, desks, and other such enclosures. Moreover, lock 10 may be configured for use with non-combination or non-combination changing locks (e.g., key only operated locks) or any other lock capable of manipulating a movable feature of the lock mechanism disclosed in the present application. The majority of attached FIGS. illustrate the lock without its cover, dial mechanism and combination lock mechanism to better illustrate the components of the latch or lock mechanism in accordance with exemplary embodiments of the present invention.

The locker will have a frame or wall 9 having a striker plate 18 configured to engage a latch or latch mechanism 20 of the lock 10.

Figure 2A:
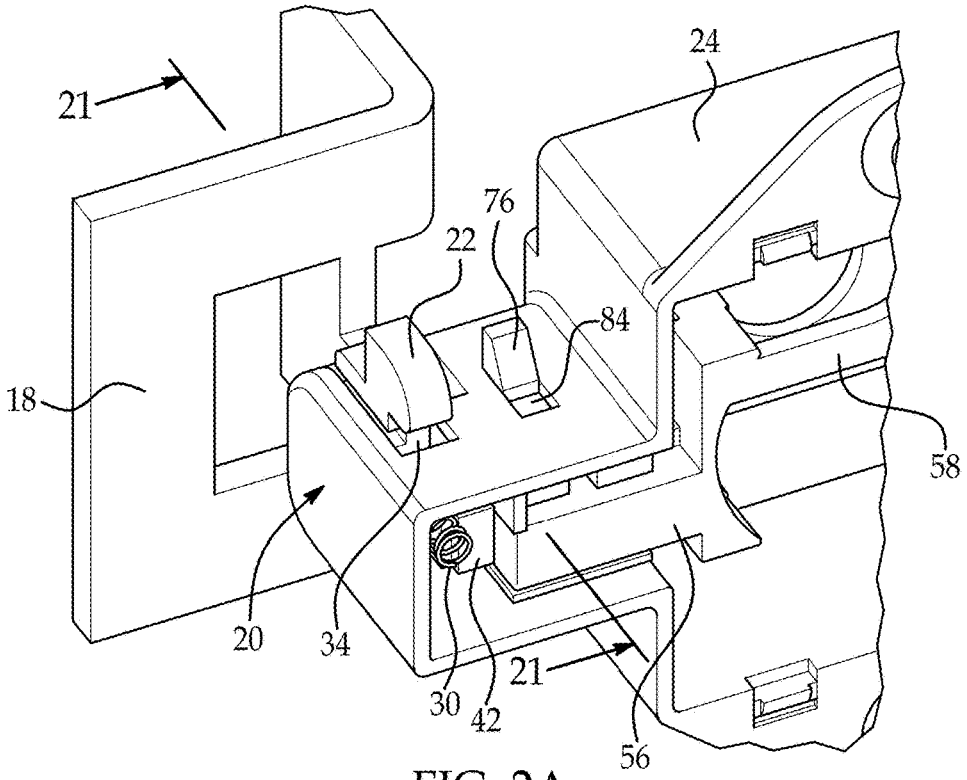
FIGS. 2A-2C illustrate movement of components of the latch mechanism from a first position to a second position.
Figure 2B:
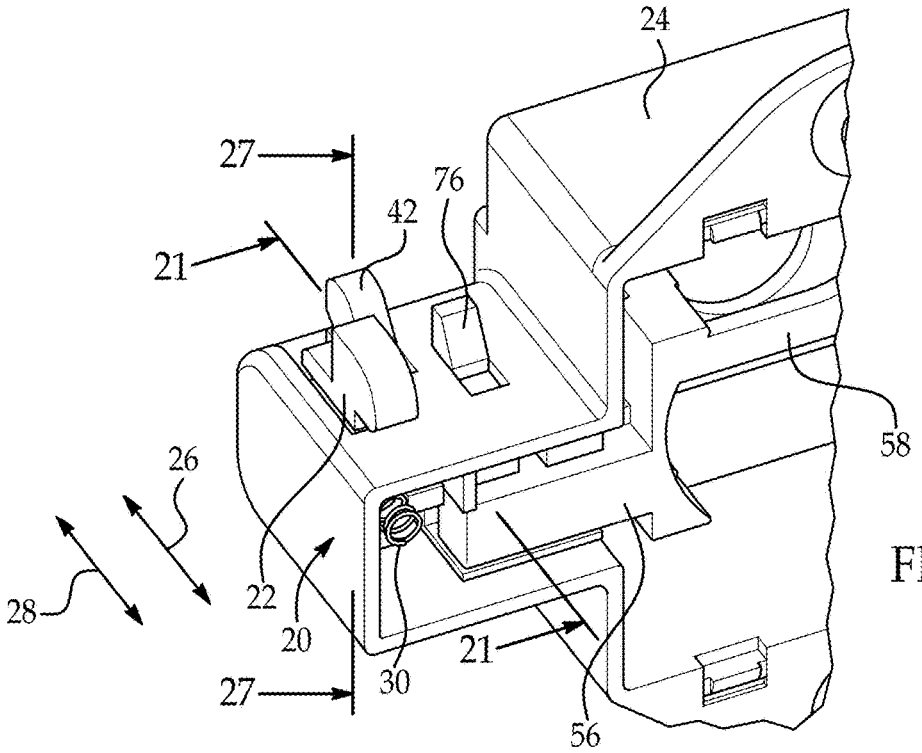
Figure 2C:
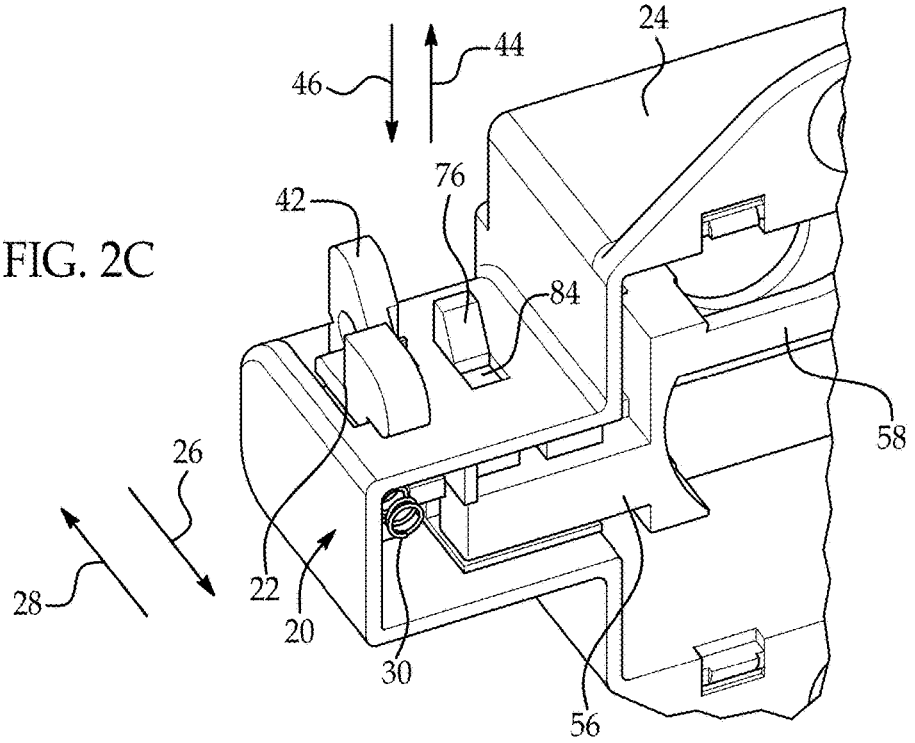

The latch or latch mechanism 20 is configured to move from an unlatched or unlocked position (see at least FIG. 2A) to a latched or locked position (see at least FIG. 2C) wherein a first member or a slider 22 of the latch mechanism 20 moves with respect to a housing 24 of the lock 10. FIG. 2B illustrates movement between the unlatched or unlocked position and latched or locked position. The first member or slider 22 is configured to move or slide in the directions of arrows 26, 28 with respect to the housing 24. In one embodiment, the first member or slider 22 is spring biased in the direction of arrow 28 by a spring or other equivalent member 30 located within the housing 24. In one embodiment, spring 30 is configured to be received within an opening 31 of first member or slider 22.

First member or slider 22 is configured to have a hook feature 32 that protrudes through an opening 34 in the housing 24 when first member or slider 22 is secured to the housing 24. Hook feature 32 provides a surface 36 that is configured and positioned to interact with a surface of striker plate 18 when striker plate 18 interacts with the first member or slider 22 or in other words when a door having the lock 10 secured thereto is closed striker plate 18 will contact surface 36 and move the first member or slider in the direction of arrow 26.

In one non-limiting embodiment, first member or slider 22 is configured to have an elongated slot or channel 38 that is configured slidably receive a complimentary feature of housing 24 therein such that movement of first member or slider 22 in the directions of arrows 26 and 28 is achieved without binding first member or slider 22. In other words, channel 38 helps facilitate the sliding movement of first member or slider 22 with respect to the housing 24. In addition, a feature 40 is located on another surface of first member or slider 22. As will be described herein, feature 40 cooperates with a second member or hook 42 of the lock mechanism 20 in order to facilitate movement of the second member or hook 42 with respect to housing 24.

Second member or hook 42 is configured for movement in the direction of arrows 44, 46 with respect to housing 24 as first member or slider 22 moves in the direction of arrows 26 and 28 with respect to housing 24. First member or slider 22 is movably coupled to a second member or hook 42 such that as striker plate 18 contacts a surface 36 of first member or slider 22, first member slider 22 moves in the direction of arrow 26 and second member or hook 42 moves in the direction of arrow 44. Lock 10 and lock mechanism 20 are configured such that second member or hook 42 is positioned below a surface of the housing 24 such that as the striker plate moves into contact with surface 36 it will pass over second member or hook 42 and subsequent movement of first member or slider 22 in the direction of arrow 26 will then cause upward movement of second member or hook 42 in the direction of arrow 44 such that a contact surface 48 is now positioned behind striker plate 18 and a portion of striker plate 18 will now be captured in a receiving area defined between surface 36 and surface 48.

Figure 10B:
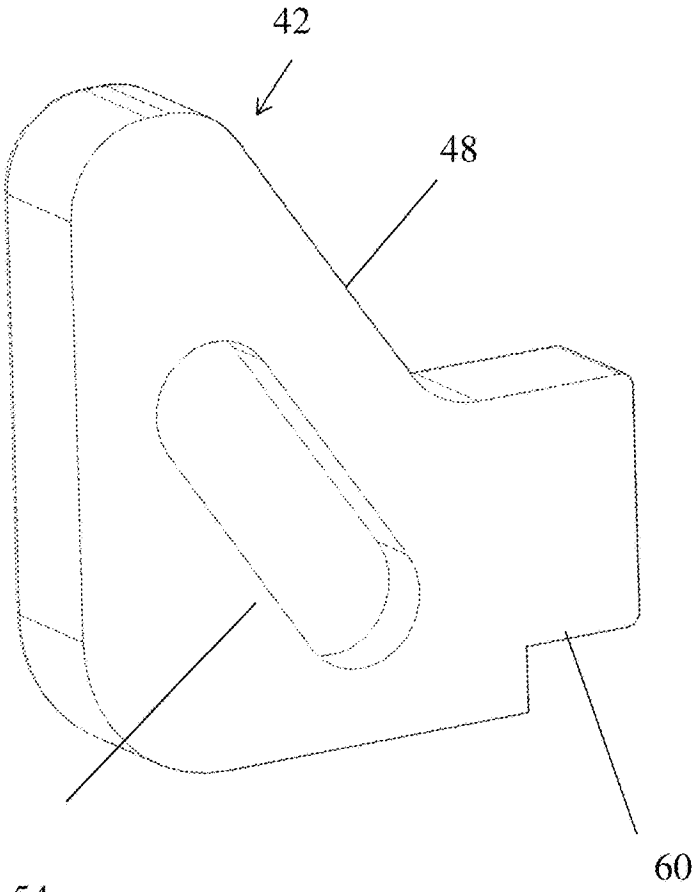
Figure 10A:
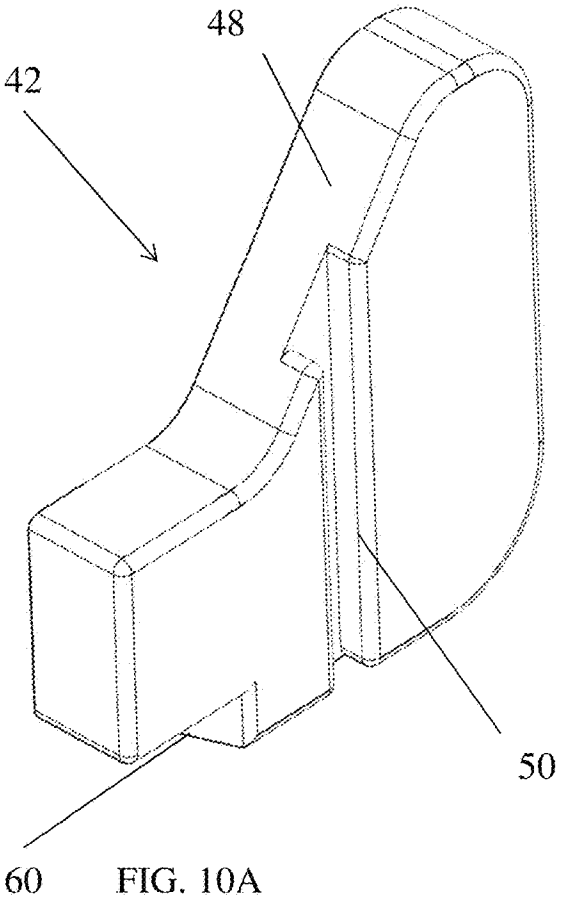
Figure 11B:
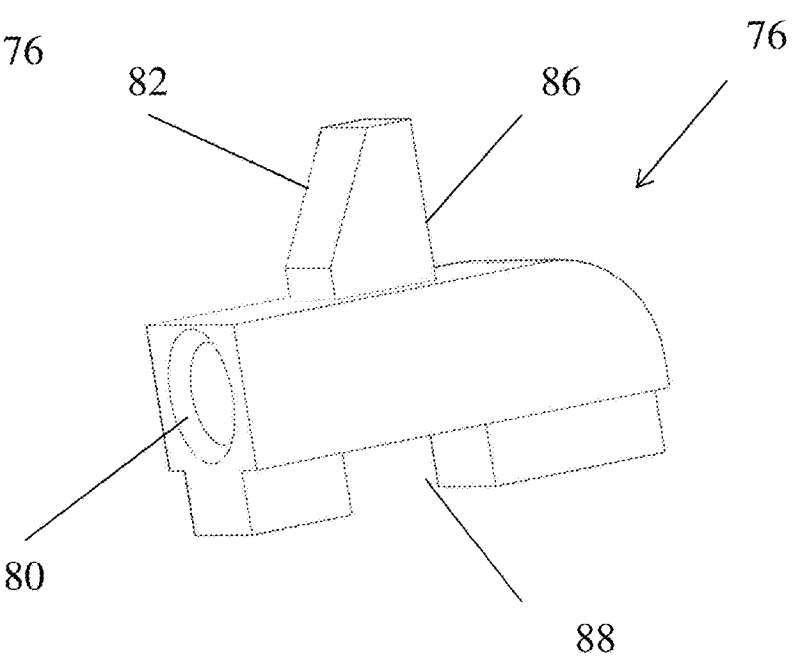
Figure 11A:
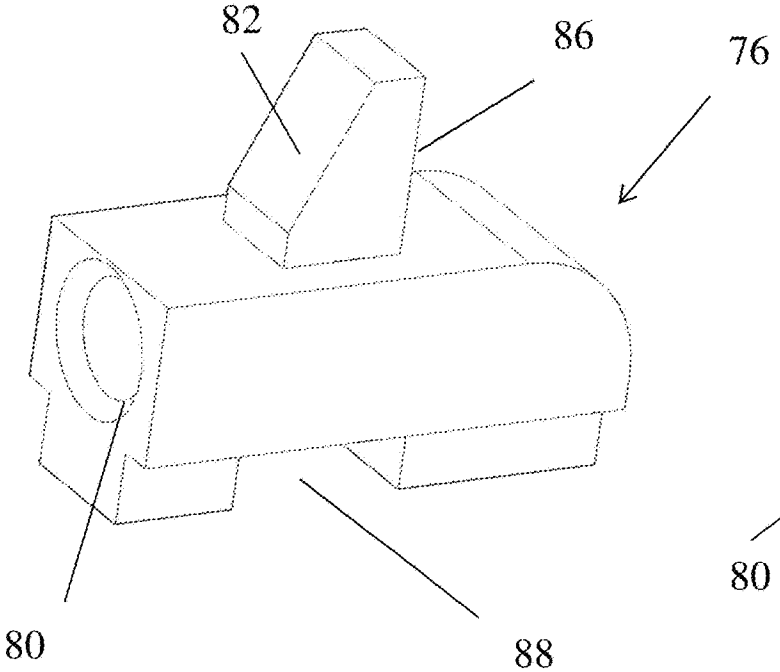
Figure 12A:
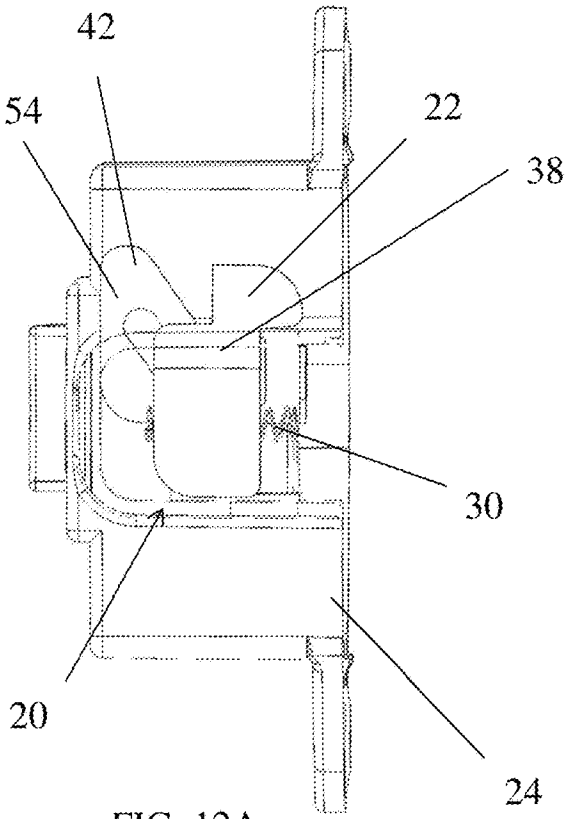
Figure 12:
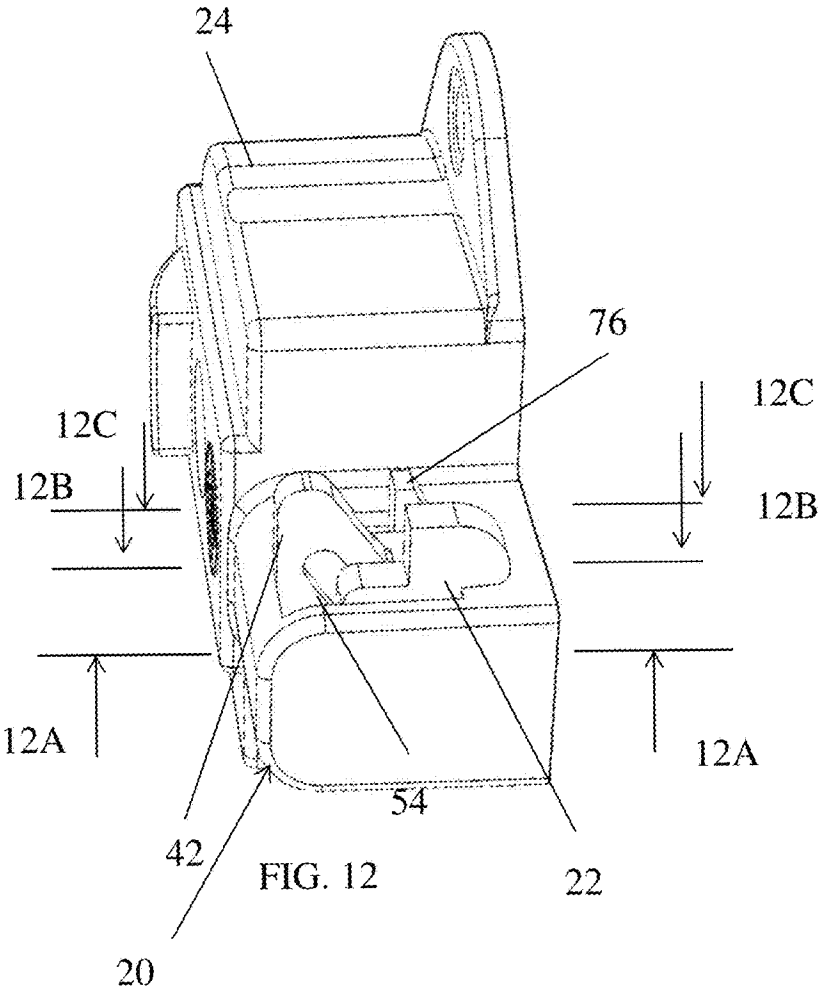
Figure 12B:
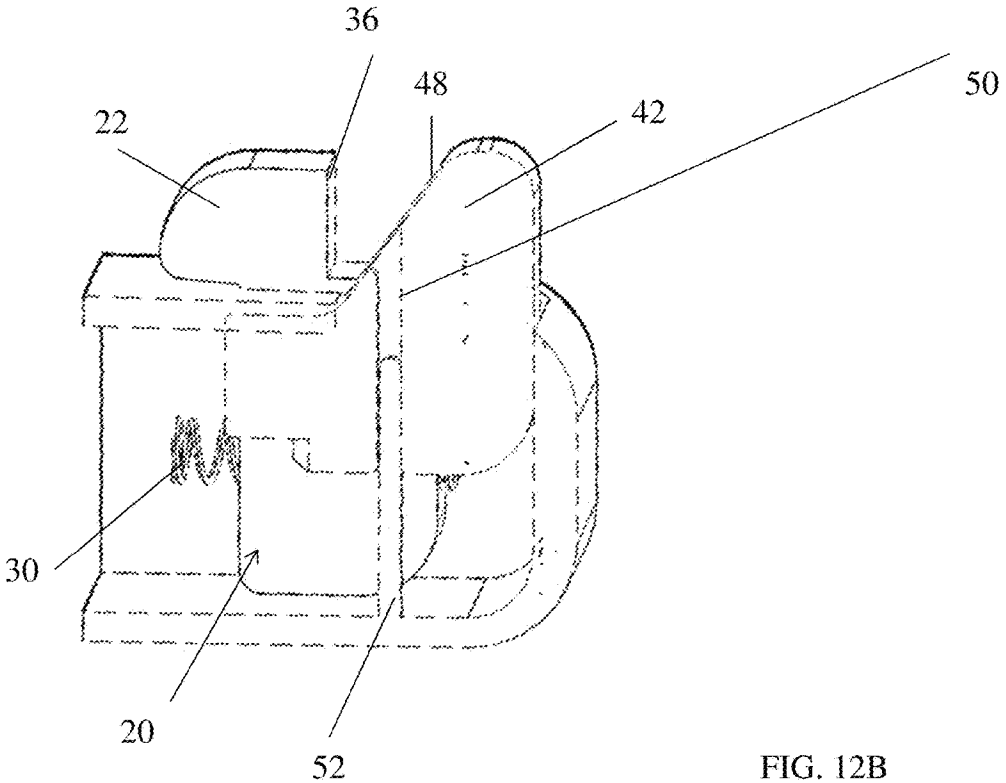
Figure 12C:
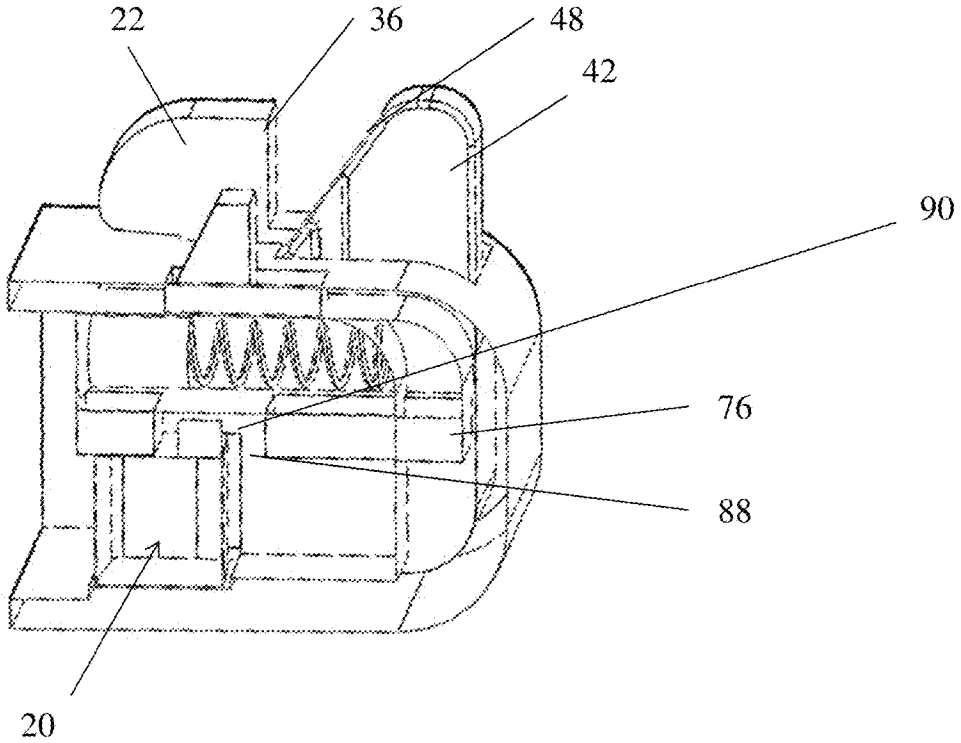

Referring now to at least FIGS. 10A, 10B and 12B, second member or hook 42 is configured to have a slot or channel 50 that is configured to slidably engage a feature 52 of the housing 24. Similarly to the first member or slider 22, slot or channel 50 helps facilitate movement of the second member or hook 42 in the direction of arrows 44 and 46. In addition and in order to provide the cooperative engagement between first member or slider 22 and second member or hook 42, a surface of second member or hook 42 is configured to have an opening 54 that is configured to slidably received protrusion or feature 40 therein when first member or slider 22 and second member or hook 42 are movably secured to housing 24.

As illustrated in the attached FIGS., movement of first member or slider 22 in the directions of arrows 26 and 28 will cause complementary movement of second member or hook 42 in the direction of arrows 44 and 46. In one non-limiting exemplary embodiment and due to the configuration of protrusion 40 and opening 54 horizontal or linear movement (also illustrated as the y axis in at least FIG. 2B) of the first member or slider 22 in a first plane 21 will cause vertical or linear movement (also illustrated as the x axis in at least FIG. 2B) of the second member or hook 42 in a second plane 27, which is different from the first plane.

In addition, and since the first member or slider 22 is spring biased in the direction of arrow 28, first member or slider 22 will move in the direction of arrow 28 causing second member or hook 42 to move downwardly in the direction of arrow 46 unless movement of either the first member 22 or the second member 42 is prevented by another feature or lock.

In order to prevent movement of the second member or hook downwardly in the direction of arrow 46 (e.g., back into the housing) when the striker plate 18 has engaged the first member or slider 22 and moved it in the direction of arrow 26 against the biasing force of spring member 30, a locking feature 56 of a bolt 58 makes contact with a surface 60 of the second member or hook 42 when the second member or hook 42 is in a second or locking position with respect to housing 24 (e.g., moved upwardly in the direction of arrow 44) and the bolt is in a blocking position such that feature 56 is positioned below surface 60 and prevents movement of the second member or hook 42 downwardly in the direction of arrow 46 when the second member or hook 42 is in the second or locking position with respect to the housing.

In order to provide this feature, bolt 58 is slidably received within the housing 24 such that bolt 58 can move in the direction of arrows 62 and 64 in response to a combination lock mechanism that engages opening 70 of bolt 58 in order to facilitate movement of the same in the direction of arrows 62 and 64 when a correct combination has been applied to the combination lock mechanism. One non-limiting example of such a lock mechanism is illustrated in U.S. Pat. No. 3,190,089, the contents of which are incorporated herein by reference thereto. Of course, any suitable mechanism for facilitating the movement of the bolt 58 in the direction of arrows 62 and 64 is contemplated. One non-limiting example would be a cam member that is rotationally received within opening 70 and is rotated by operation of the lock which is capable of being operated by manipulation of dial 94 and/or key cylinder 95 such that movement or rotation of the cam member will cause a corresponding movement of the bolt in the direction of arrow 64 such that the lock mechanism can be unlocked. For example and in one non-limiting embodiment, a portion of the cam member or any other equivalent member when rotated or moved by operation of the lock contacts a portion of the bolt such that further movement of the cam member or any other equivalent member causes the bolt 58 to be moved against the biasing force of the spring 72 in the direction of arrow 64 such that a portion of the bolt is no longer in locking engagement with the second member or hook 42 or is no longer in the blocking position. Thereafter and when the lock is released the biasing force of spring 72 urges bolt 58 in the direction of arrow 62. Of course, numerous other equivalent mechanisms for providing the desired movement of bolt 58 are contemplated to be within the scope of exemplary embodiment of the present invention.

Figure 4:
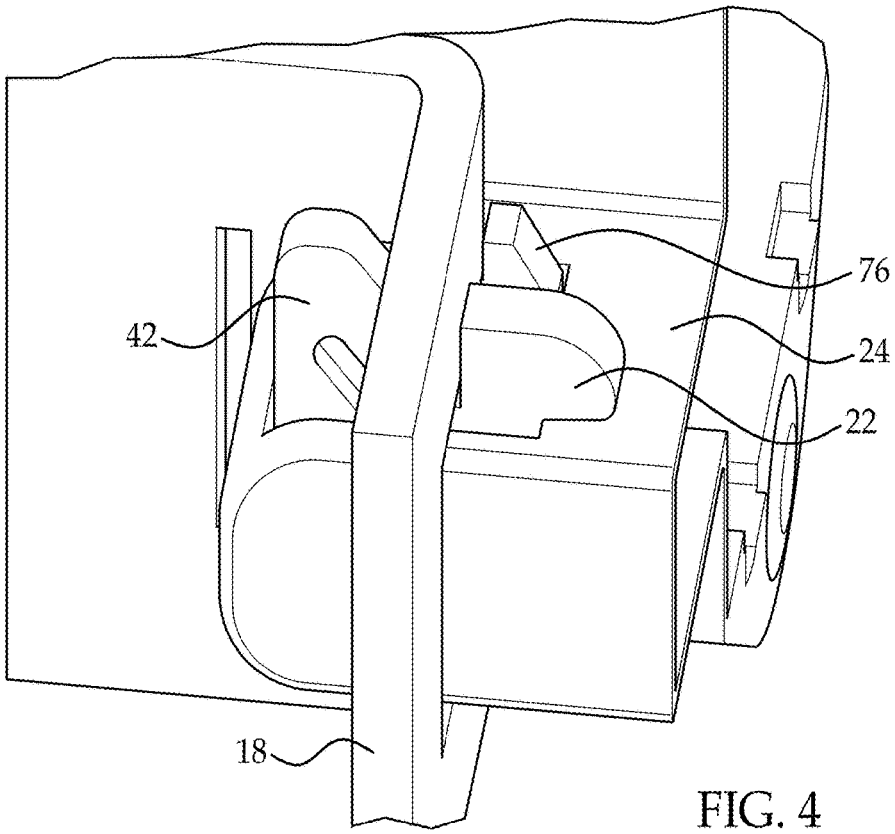

As illustrated in the attached FIGS., the first member or slider 22 is configured for movement between a first position, wherein the slider is biased in the direction of arrow 28 (FIG. 2A) to a second position (FIG. 2C) wherein the biasing force of spring member 30 is overcome by contact with a striker plate 18 and the first member or slider moves in the direction of arrow 26 until it reaches the second position. Since the first member or slider 22 is cooperatively engaged with second member or hook 42, second member or hook 42 has a corresponding first position wherein the second member or hook 42 is received within a cavity of housing 24 when the first member or slider 22 is in the first position. Thereafter and when the first member or slider 22 is moved into the second position, the second member or hook 42 will move upwardly in the direction of arrow 44 until second member or hook 42 protrudes outwardly from housing 24 and reaches a second position (See at least FIGS. 2C and 4). As discussed above, when the first member or slider 22 is in the second position and the second member or hook 42 is in the second position, a portion of the striker plate will be captured between surface 32 and surface 48 of the first and second members.

Figure 3:
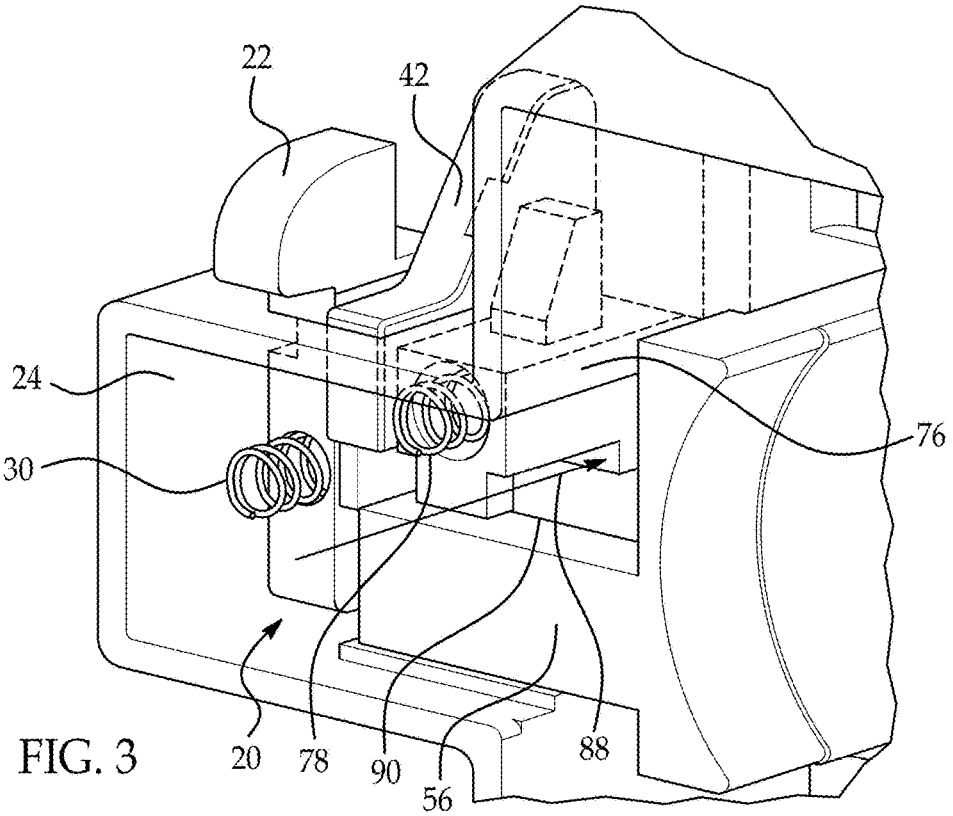
FIGS. 3-12C are various views illustrating a lock in accordance with various exemplary embodiments of the present invention.
Figure 5:
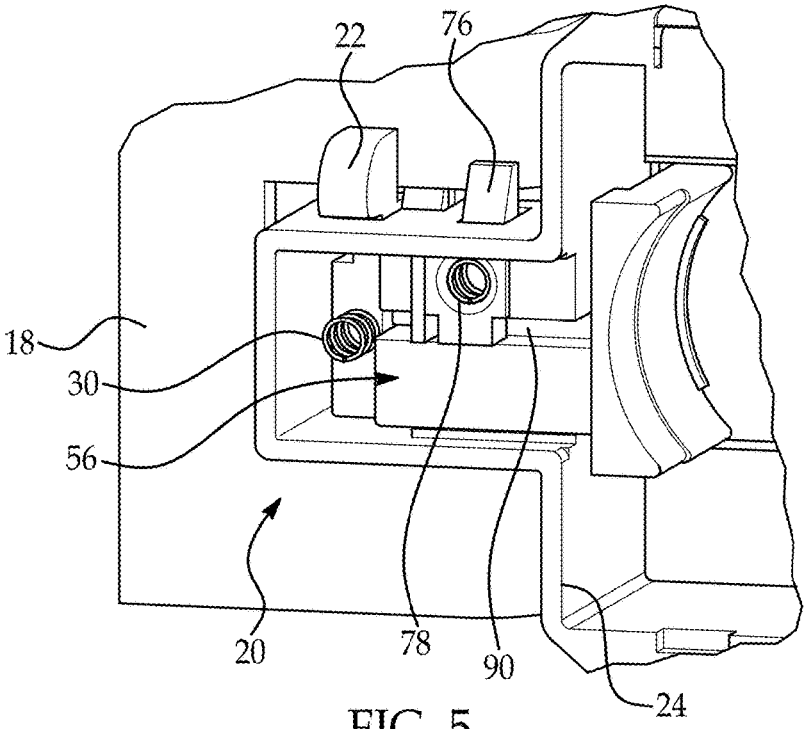
Figure 6:
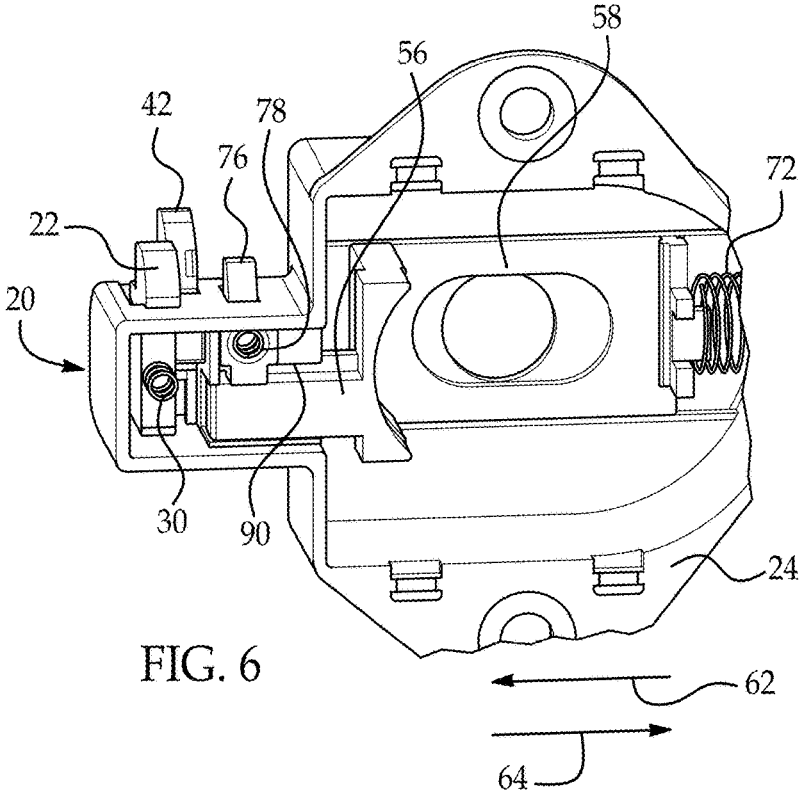
Figure 7:
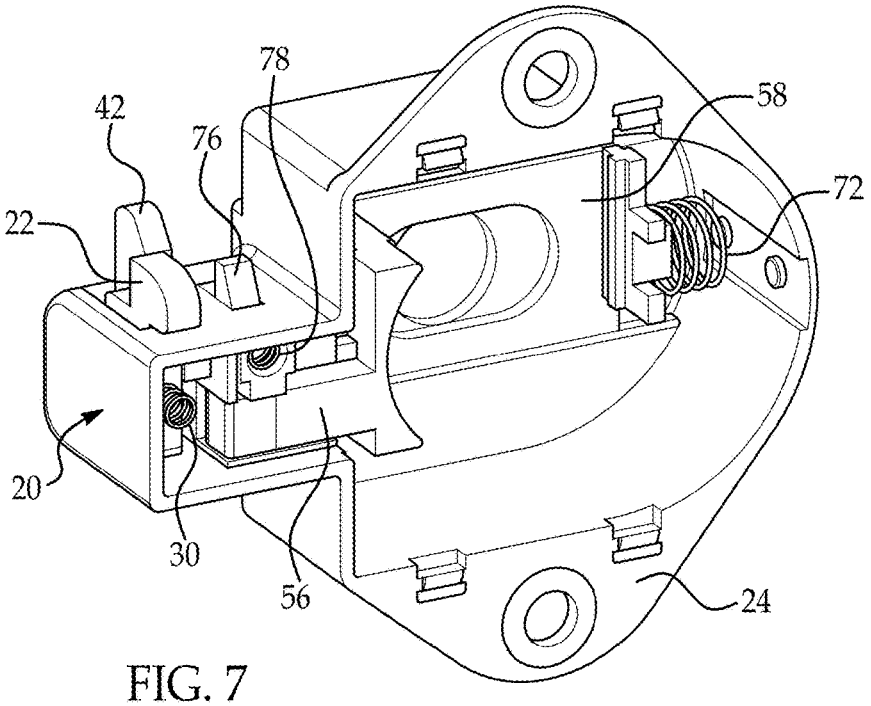
Figure 8B:
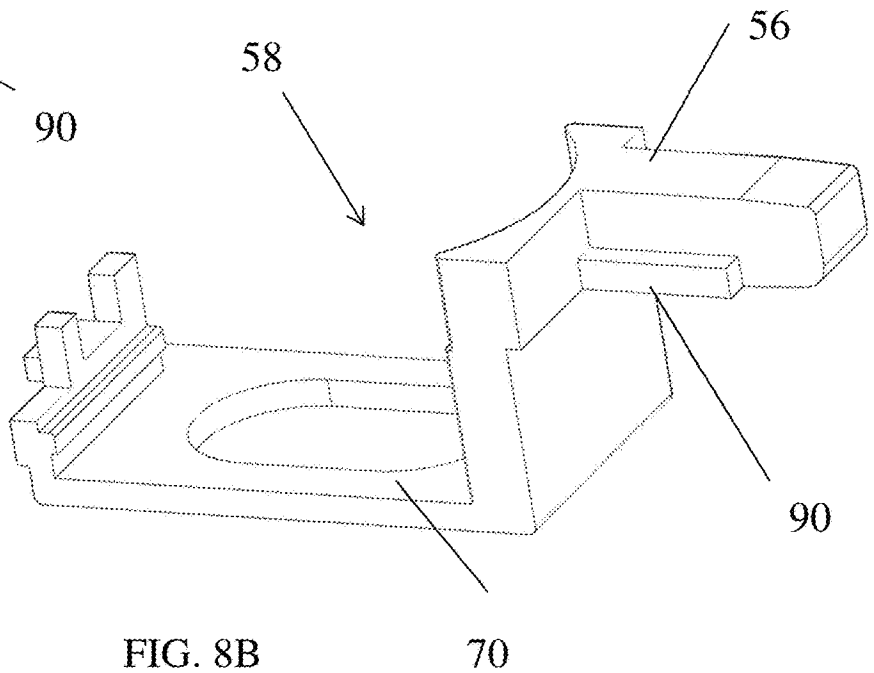
Figure 8A:
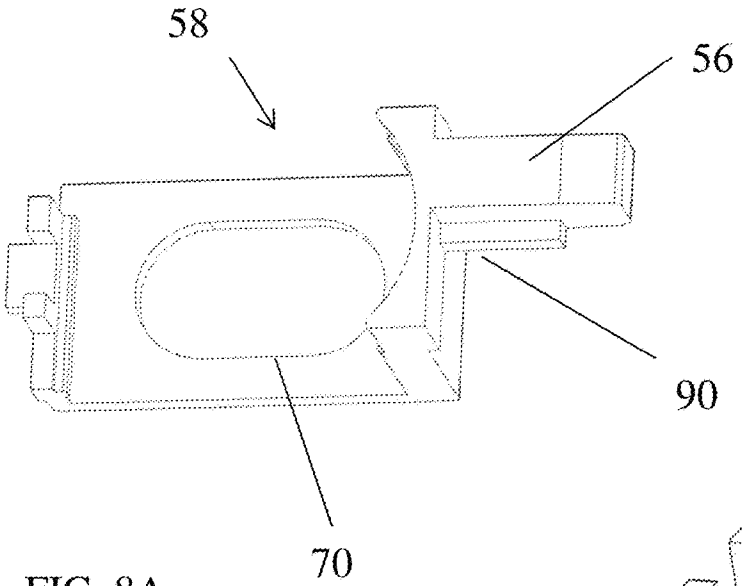
Figure 9B:
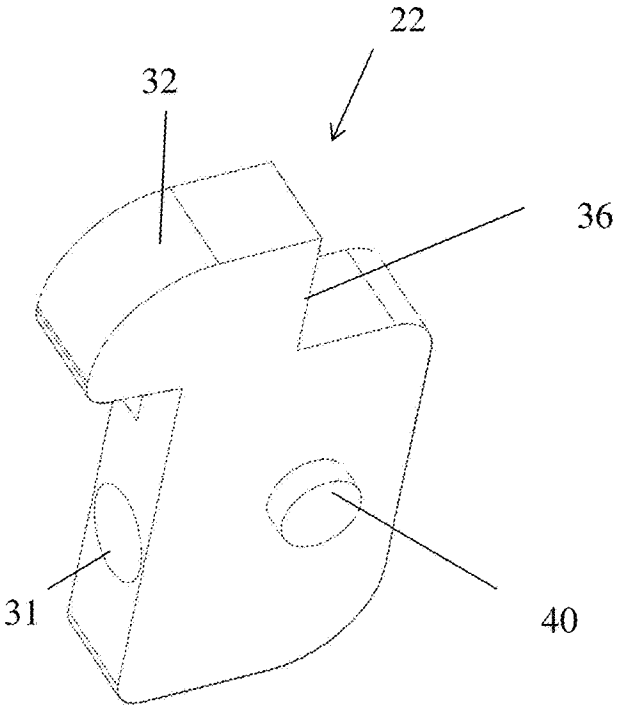
Figure 9A:
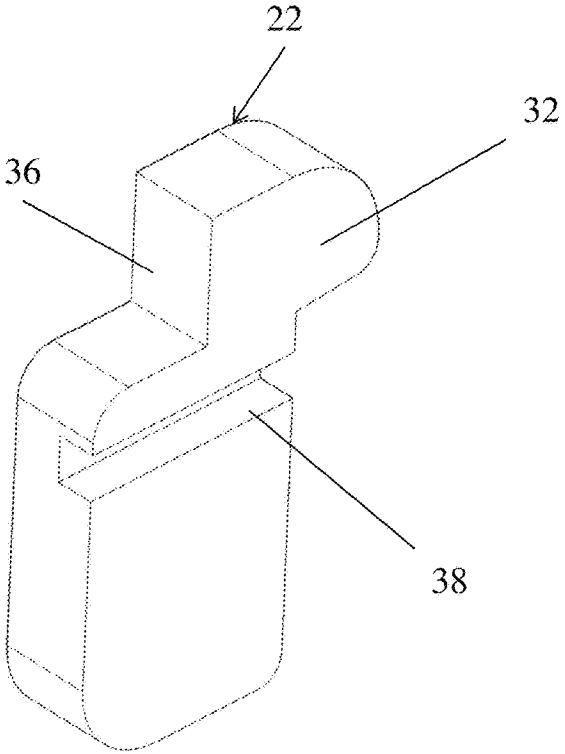

In addition, bolt 58 is also configured for movement between a first position illustrated in at least FIGS. 2A, 2B, 6 and 7 and a second position illustrated in at least FIGS. 3 and 5. When the bolt 58 is in the second position, locking feature 56 is positioned adjacent or below surface 60 of the second member or hook 42 such that movement of the same downwardly from the second position into the first position of the second member in the direction of arrow 46 is prevented (e.g., the lock is locked and the striker plate is engaged between the first member 22 and the second member 42). Thereafter and in order to release the striker plate, the bolt must be moved from the second position into the first position by traveling in the direction of arrow 64. As mentioned above this is achieved by inputting a correct combination or key into a lock mechanism so that a rotatable feature can engage opening 70 and bolt 58 in the direction of arrow 64 such that it is in the first position.

When the bolt is in the first position, second member or hook 42 is free to move downwardly in the direction of arrow 46 and the first member or slider 22 is free to move into the first position from the second position in the direction of arrow 28 due to the biasing force of spring 30. In one embodiment, bolt 58 is spring biased in the direction of arrow 62 by a spring 72.

In one non-limiting embodiment and in order to prevent inadvertent locking of the locking mechanism 20, bolt 58 is prevented from moving in the direction of arrow 62 into the second position of the bolt (e.g., locking position) by a third member, actuator, locking member or anti-locking member 76. It is, of course, also understood that the lock 10 can be configured to operate without an anti-locking member. (See for example, FIGS. 33A-34B) In this embodiment, the locking mechanism 20 of the lock 10 is configured to operate in a similar fashion however there simply is no a third member, actuator, locking member or anti-locking member 76 otherwise operation of the lock 10 and/or locking mechanism is similar to the other embodiments disclosed herein.

Referring back now to the embodiment that include a third member, actuator, locking member or anti-locking member 76 and as illustrated in the attached FIGS., locking member 76 is slidably received within housing 24 and is configured for movement between a first position (see at least FIGS. 2A and 7) and a second position (see at least FIGS. 3-5) in the direction of arrows 26 and 28. Similarly to the first member or slider 22, locking member 76 is spring biased into the first position by a spring 78 which is partially received within an aperture or opening 80 of the locking member 76. In addition, locking member 76 has a feature 82 that protrudes through an opening 84 in the housing 24. Feature 82 provides a contact surface 86 that is located to be contacted by a portion of the striker plate 18 as another portion of the striker plate 18 contacts a surface 36 of the first member or slider 22. As illustrated, first member or slider 22 is offset from feature 82 of locking member or locking member 76. Accordingly, locking member 76 and first member or slider 22 are positioned to contact different discrete portions of the striker plate in order to prevent inadvertent locking of the lock mechanism as will be discussed below. Thus, locking member 76 provides an anti-locking function unless locking member 76 is moved into a correct position to allow for locking of the lock.

Locking member 76 has an opening or slot 88 that is configured to be in a blocking position with respect to a feature 90 located on feature 56 of bolt 58 when the locking member 76 is in the first or blocking position. When the locking member 76 is moved in the direction of arrow 26 into the second or unblocking position the opening or slot 88 is no longer in a blocking position with respect to feature 90 and accordingly 58 can move from the first position to a second position in the direction of arrow 62 due to the biasing force of spring 72. Accordingly, locking member 76 must be manipulated from the first position to the second position such that opening 88 will allow feature 90 to pass therein and thus locate feature 56 below surface 60 of the second member or hook 42. See at least FIGS. 3 and 4 wherein feature 90 is allowed to pass-through opening 88 locking member 76 has been moved from the first position to the second position by the striker plate 18.

Once a correct combination has been applied to the locking device or key is inserted therein a user can manipulate the bolt back to the first position and spring 78 will cause locking member 76 to move back into the first position such that bolt 58 will be prevented from sliding into the second position from the first position unless locking member 76 is once again manipulated from the first position to the second position. As illustrated in the attached FIGS. movement of the lock mechanism is in a similar plane to that of the first member or slider 22 of course, other locations and planes are contemplated to be within the scope of exemplary embodiments of the present invention.

In accordance with one embodiment of the present invention the combination of the lock mechanism 20 (e.g. first member 22 and second member 42) and plate 18 provides a more robust securement of the door to the locker frame. In contrast to previous designs wherein a bolt is slid into and out of an opening in the frame of the locker, the locked locker may be breached by prying the frame away from the bolt of the lock a sufficient amount to cause the bolt to no longer be received within the opening of the frame. Moreover, the distance the bolt extends from the housing is limited due the components of the combination lock (e.g., the throw of the bolt is limited). However and in accordance with an exemplary embodiment of the present invention the lock mechanism engages the plate 18.

In order to manipulate the latch into the unlocked position, a correct combination is submitted via a dial 94 of a combination lock wherein the bolt 58 is retracted from the blocking position or second position to first or unblocking position and the first member or slider 22 and the second member or hook 42 are spring biased into a respective first or un-locking positions. Thereafter and in order manipulate the lock mechanism into a locked position and as the locker door having the lock mounted thereto closes upon the striker plate the first member or slider 22 and the second member or hook 42 as well as locking mechanism 76 are manipulated from their respective first positions to their respective second positions which causes the lock mechanism 20 to be in a locked state such that a portion of the striker plate is captured between surfaces 36 and 48 of the first member and the second member.

The first member 22 and the second member 42 will maintain this lock state until a correct combination is once again entered in or alternatively a key is used to actuate a lock that causes the bolt 58 to move from the second blocking position to the first unlocking or unblocking position.

Also, most of the lock mechanism 20 (except for the contact or engagement portions) are encased in the housing to prevent any abuse to components. Lock 10 is configured such that upon entry of the correct combination bolt 58 is retracted from the second position wherein the bolt prevent movement of the second member or hook member 42 from moving from the second locked position to the first position wherein the bolt or feature 56 of the bolt is no longer in the blocking position with respect to the second member or hook 42.

In accordance with an exemplary embodiment of the present invention and as mentioned above bolt 58 is biased into the second position by at least one spring member and as mentioned above the third member, actuator or locking member 76 prevents bolt 58 from moving into the second position unless the third member, actuator or locking member 76 is moved from the first position to the second position. In order to unlock the lock and overcome this biasing force an operator by providing the correct combination to the combination lock will then be able to rotate a dial of the lock wherein bolt 58 is retracted from the second position to the first position and the first member and the second member are free to move from their corresponding second positions to their first positions and thus place the lock mechanism into an unlocked position. In addition, the third member 76 also moves back to its first position from its second position such that once the force applied against the bolt 58 is removed bolt 58 will travel back towards its second position however the third member, actuator or locking member 76 is now back in its first or blocking position such that movement of the bolt into its second position is prevented. Alternatively, a key is used. It is noted that operation of the bolt (e.g., movement back and forth), and combination lock is in one embodiment similar to that illustrated U.S. Pat. No. 3,190,089 to Foote et al. the contents of which are incorporated herein by reference thereto.

For example, bolt 58 is similar to the bolt illustrated in FIGS. 3-8 and 3-14 of U.S. Pat. No. 3,190,089 except that the bolt moves within the housing of the lock and the bolt 58 has a feature 90 configured to engage locking member 76. Moreover, the operation of the combination lock mechanism, master key operation and lock changing capabilities are similar to those illustrated in U.S. Pat. No. 3,190,089 or equivalents thereof.

In addition, most of the components associated with the lock mechanism are protected from abuse during as only portions thereof extend out of the housing during movement of the same from the locking to unlocking positions.

Figure 15C:
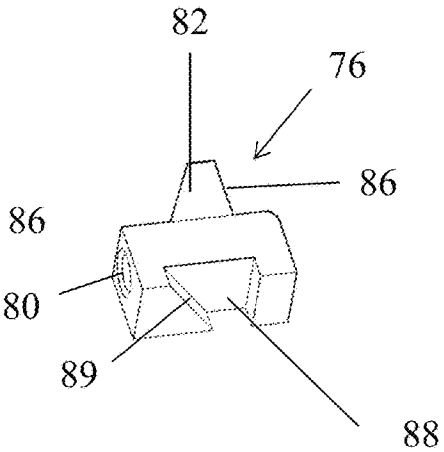
Figure 15B:
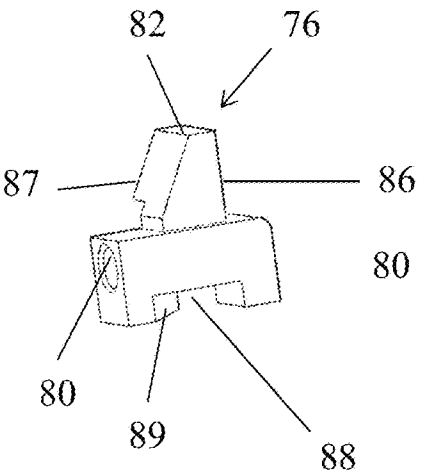
Figure 15A:
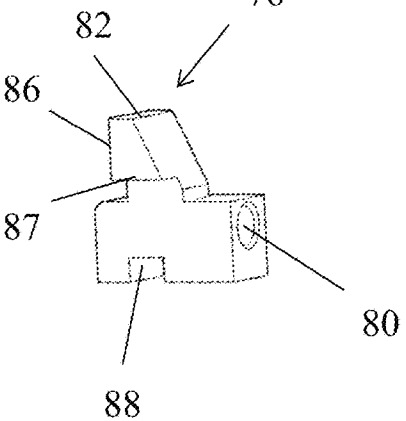
Figure 16B:
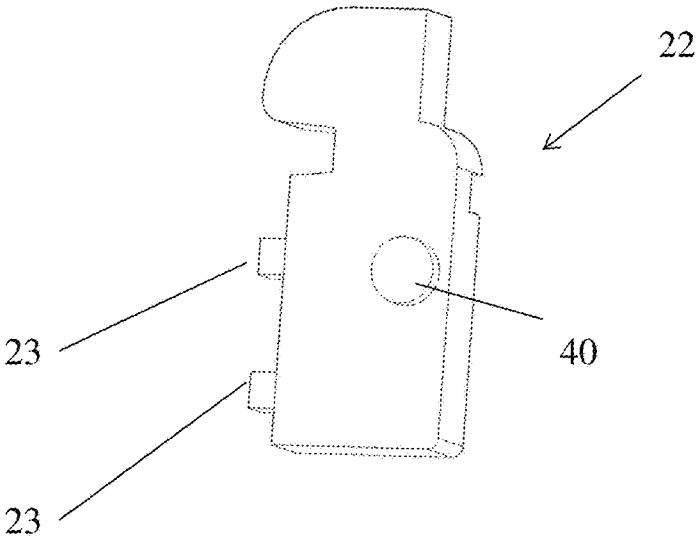
Figure 16A:
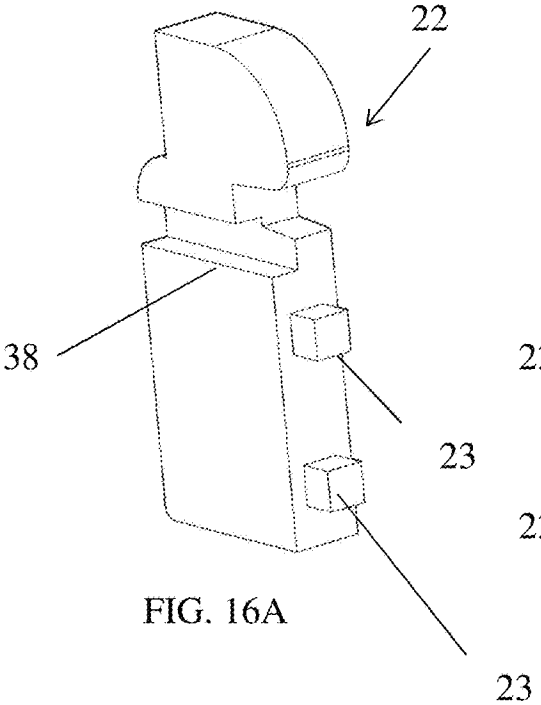

It is, of course, understood that modifications can be made to various components of the illustrated embodiments and thus still be within the scope of the claimed inventions. For example and referring now to FIGS. 13-16B, an alternative configuration of lock 10 is illustrated. In this embodiment, the third member, actuator or locking member 76 is configured such that feature 82 has an enlarged contact surface 86, which in one embodiment may be represented by a shoulder portion 87 that is located proximate to opening 84 that feature 82 travels therein. As such, the enlarged surface 86 provides a greater contact surface area for striker plate 18. As mentioned above, it is necessary for striker plate 18 or another surface to contact the third member, actuator or locking member 76 in order to transition the same from the first position to the second position such that feature 56 of the bolt 58 can be positioned adjacent to a second member or hook 42 in order to prevent the same from moving from the second position to the first position. As illustrated, the enlarged contact surface 86 is provided by shoulder portion 87 that travels above a cover plate 25 of the lock housing 24. Also shown in FIGS. 15A-15C is that opening 88 of the third member, actuator or locking member is configured to have at least one angled surface 89 providing a leading edge into opening 88 such that feature 90 is received or directed into opening 88 as the third member, actuator or locking member 76 is moved from the first position to the second position such that feature 90 can slide therethrough and the bolt 58 can move in the direction of arrow 62 such that feature 56 can be in a position to prevent the second member or hook 42 from moving from the second position to the first position.

Figure 13:
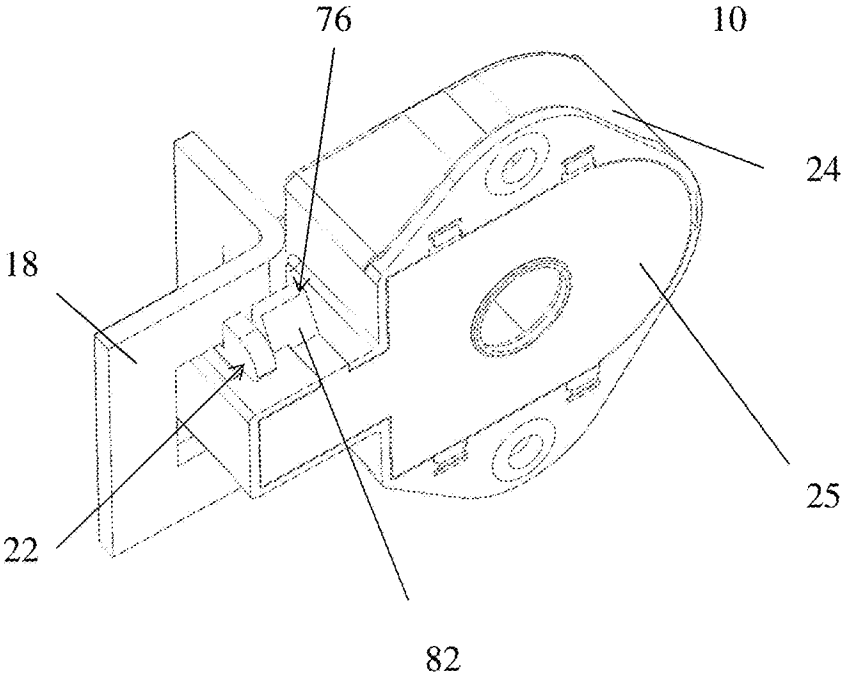
FIGS. 13-16B illustrate alternative exemplary embodiments of the present invention.
Figure 14A:
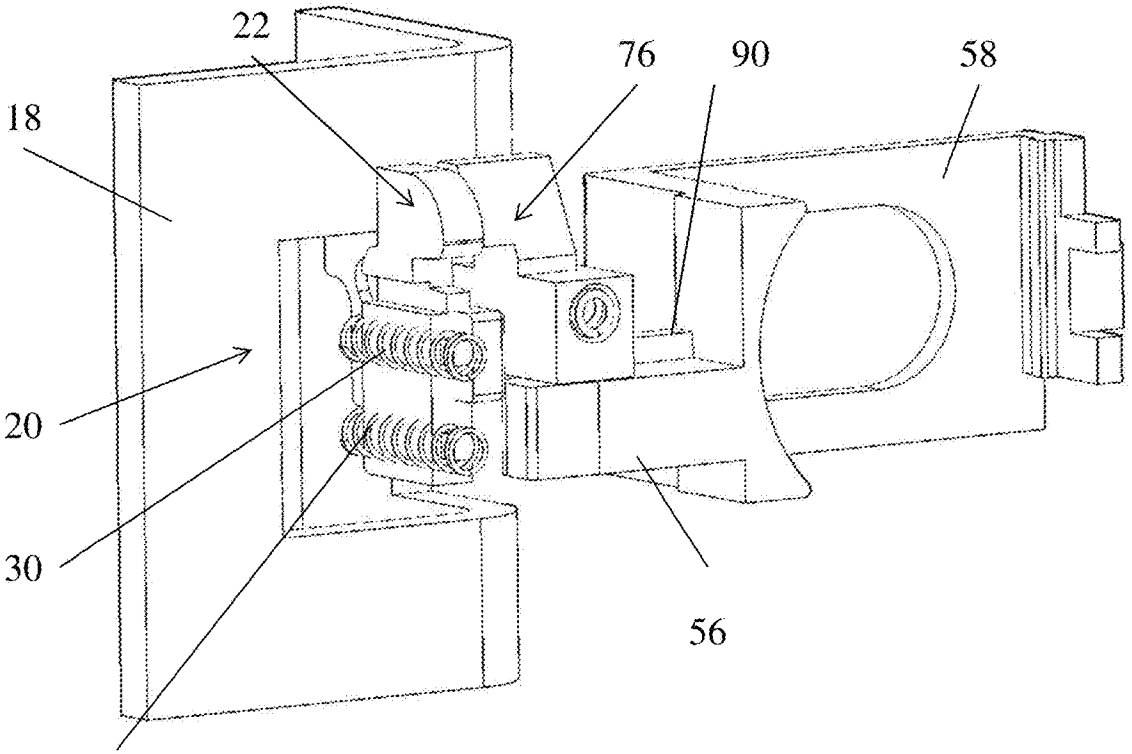
Figure 14B:
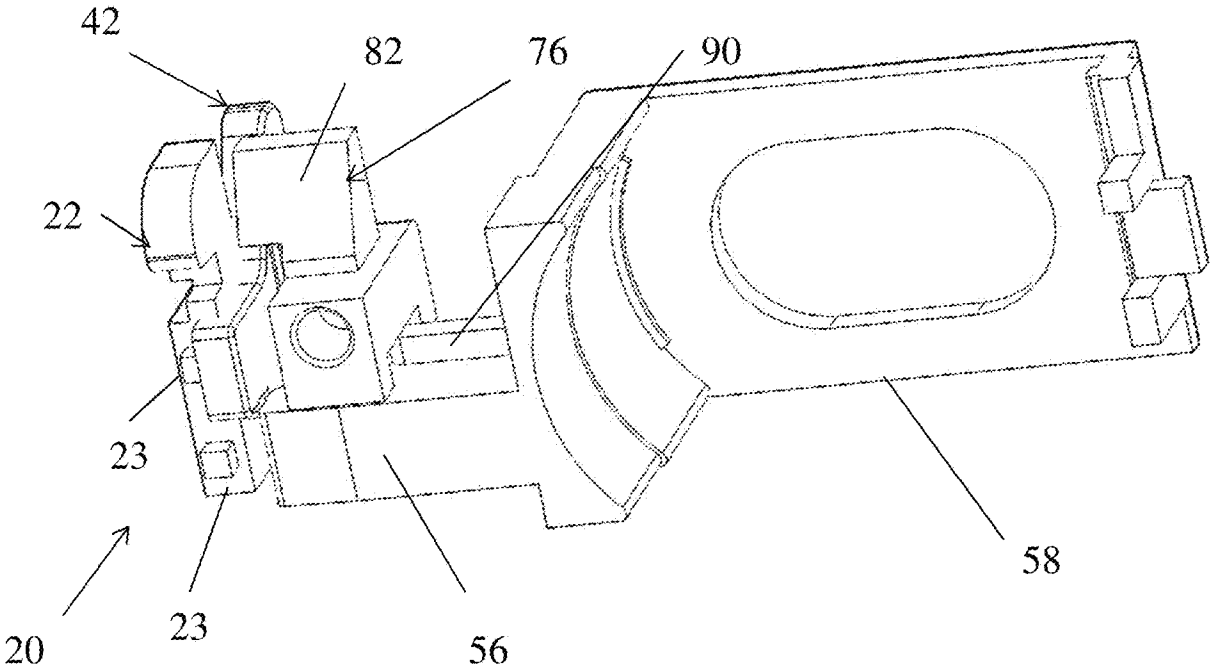

Also illustrated in FIGS. 14A and 14B and 16A and 16B is that the first member or slider 22 is configured to have a pair of protrusions 23 in order to receive a pair of springs 30 thereon such that first member or slider 22 is provided with a biasing force in the direction of arrow 28 and into the first position. It being noted that springs 30 are illustrated out of position in FIG. 14A. FIG. 13 also illustrates housing 24 with the cover plate 25 that is configured to conceal the inner lock components which interface with dial 94 and/or key cylinder 95 such that the desired movement of bolt 56 is achieved in order to manipulate the same from a locking position to an unlocking position.

Figure 17A:
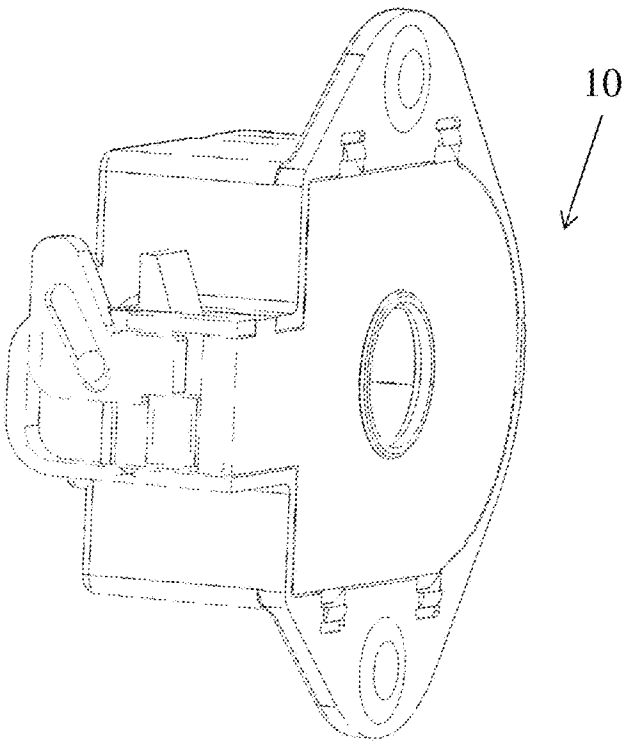
FIGS. 17-21C illustrate yet another alternative exemplary embodiment of the present invention.
Figure 17:
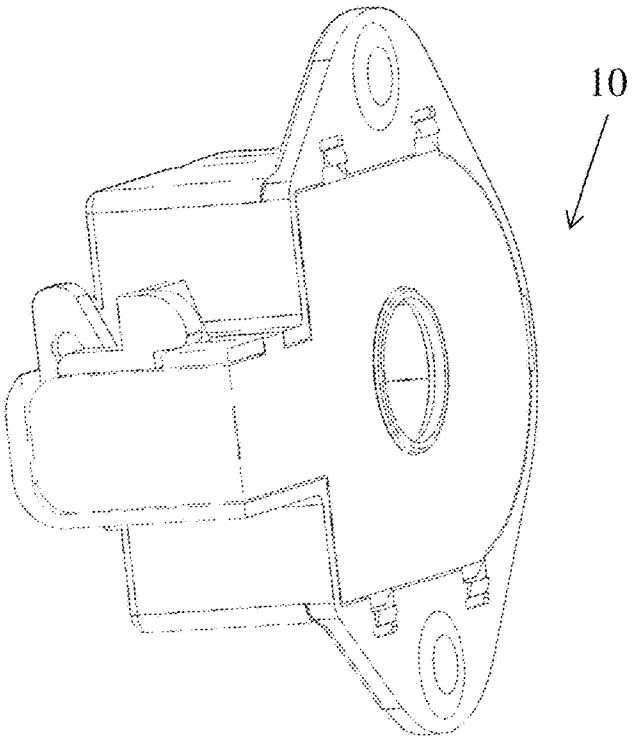
Figure 17C:
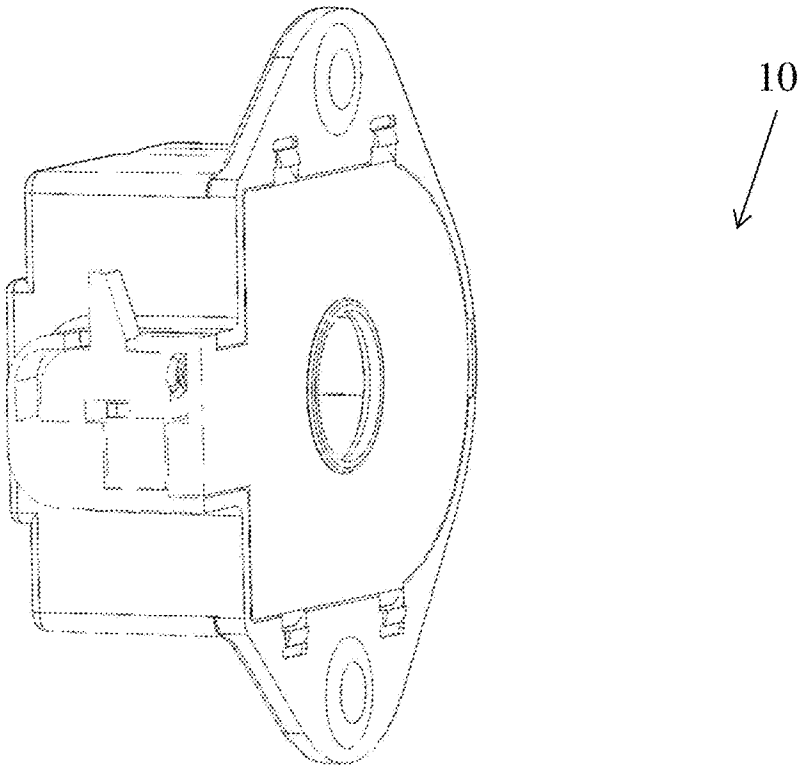
Figure 17B:
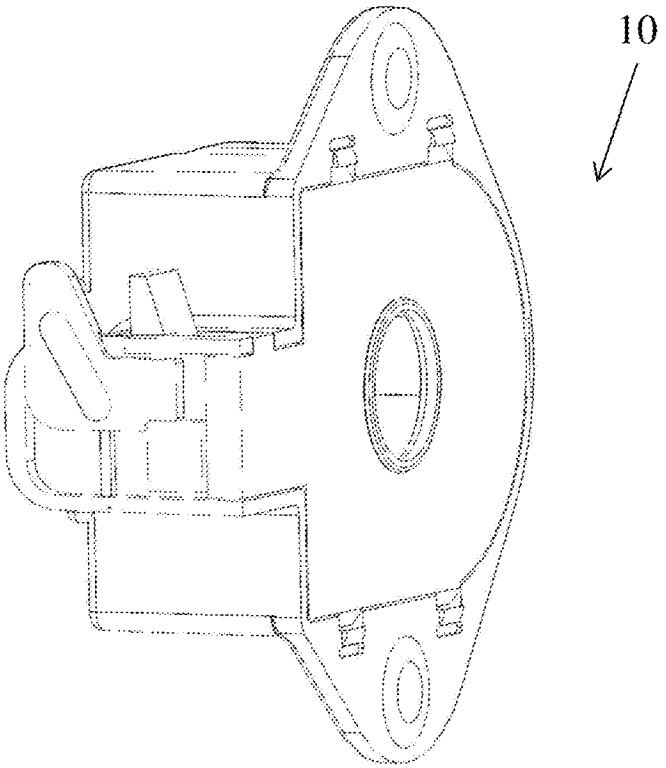
Figure 18B:
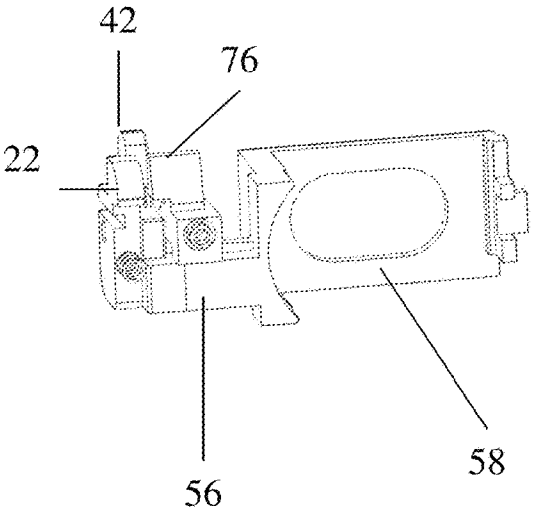
Figure 18A:
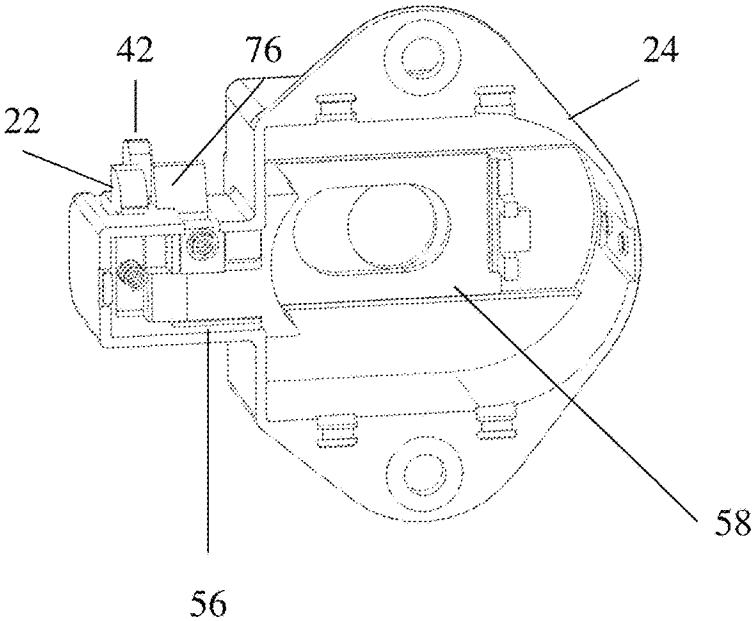
Figure 19A:
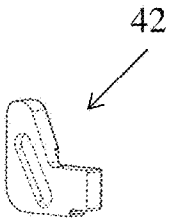
Figure 19B:
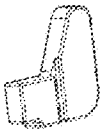
Figure 19C:
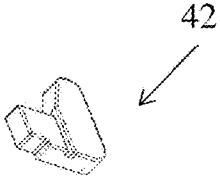
Figure 20A:
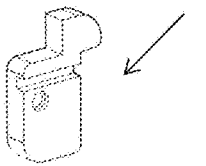
Figure 20B:
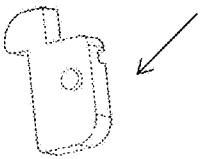
Figure 20C:
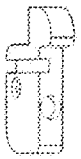
Figure 21A:
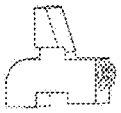
Figure 21B:
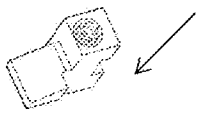
Figure 21C:
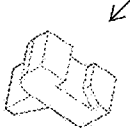
Figure 23:
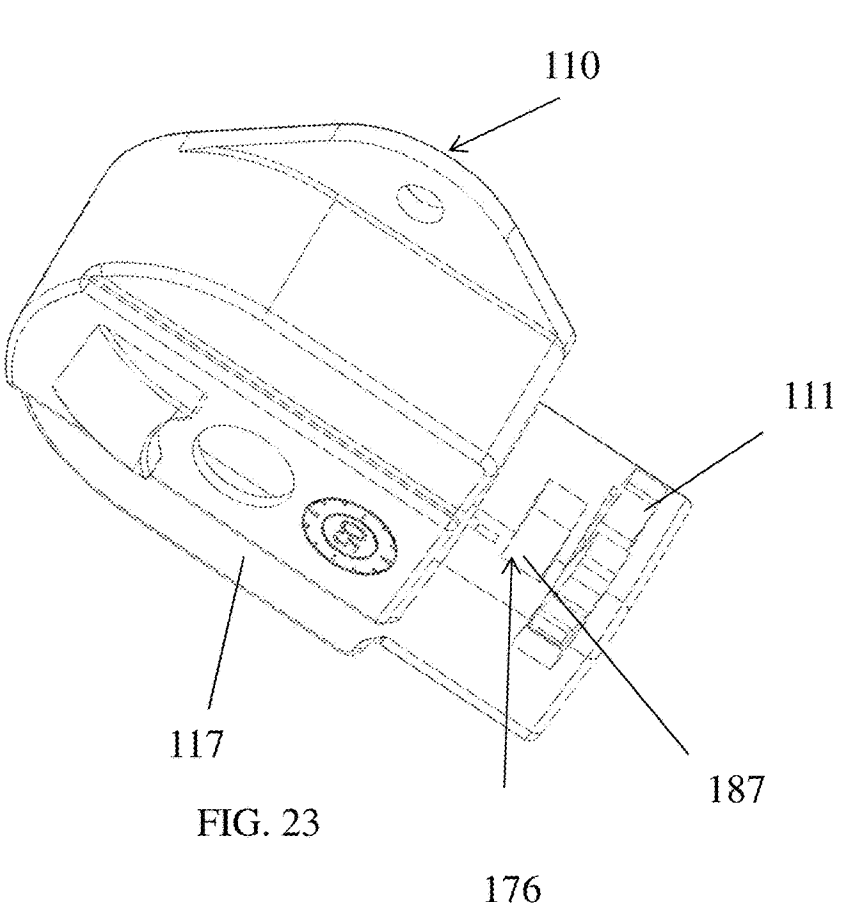
Figure 22:
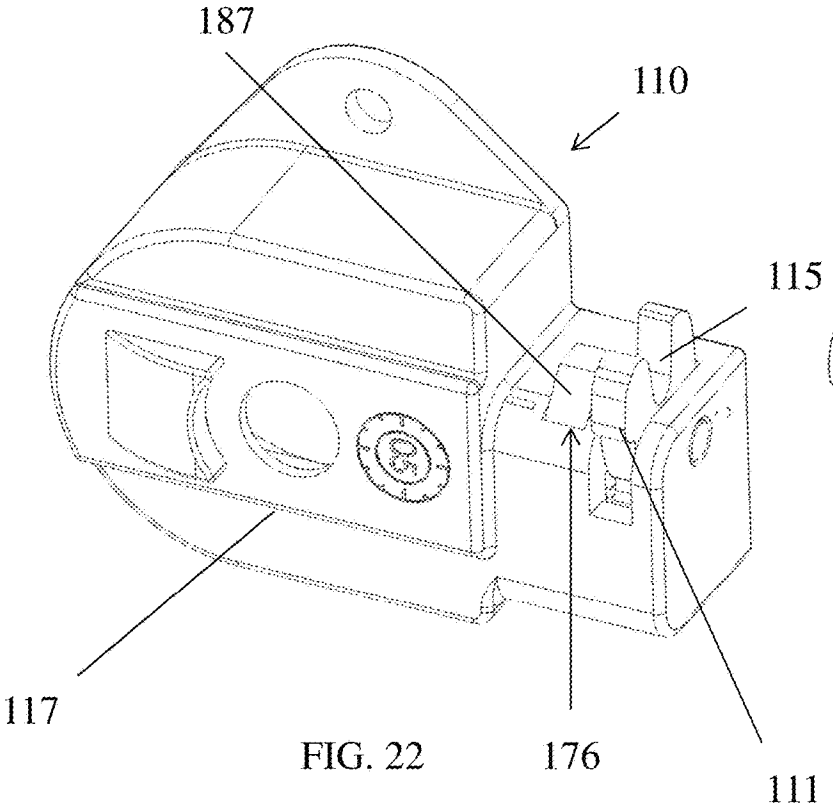

Referring now to FIGS. 17-21C yet another alternative exemplary embodiment of the present invention is illustrated. FIG. 17 is a perspective view of a portion of a lock 10 according to this embodiment while FIGS. 17A-17C are various cross-sectional views of the portion of the lock illustrated in FIG. 17. FIG. 18 illustrates a portion of the lock with the cover plate removed and FIG. 18B illustrates the bolt 58 in conjunction with the first member or slider 22, the second member or hook 42 and the locking mechanism 76 according to this embodiment. FIGS. 19A-21C are various views illustrating the configuration of the first member or slider 22, the second member or hook 42 and the locking mechanism 76 according to this embodiment.

Referring now to FIGS. 23A-28C yet another alternative embodiment is illustrated. In this embodiment a lock 110 is provided. Lock 110 has a rotary latch 111 similar to that of U.S. Provisional Patent Application Ser. No. 60/979,606 filed on Oct. 12, 2007 and U.S. patent application Ser. No. 12/250,368 filed on Oct. 12, 2008 the contents each of which are incorporated herein by reference thereto, wherein the rotary mounted spring-biased latch 111 is adapted to rotate from an unlatched or unlocked position to a latched or locked position wherein an opening 115 of the rotary mounted spring-biased latch 111 engages a portion of the hasp or bar mounted to a locker 7, door 5 or door frame 9.

The rotary mounted spring-biased latch 111 is rotatably received and mounted in a cavity of a housing 117 of the lock 110. The rotary mounted spring-biased latch is rotatably mounted to a latch pin 119 located in cavity. A spring 121 engages the latch and provides a biasing force that rotates the latch into the unlocked position.

Latch 111 further comprises a notch or slot 123 configured to engage a portion 133 of a bolt 158 of the lock when the latch is in the locked position. Lock 10 is configured such that upon entry of the correct combination bolt 158 is retracted from a first position wherein the bolt engages the notch of the latch and prevents the latch from rotating away from the locked position to a second position wherein the bolt no longer engages the notch of the rotary latch and the rotary latch is free to rotate into the unlocking position by spring 121.

In accordance with an exemplary embodiment of the present invention bolt 158 is also biased into the first position by at least one spring member. In order to overcome this biasing force an operator by providing the correct combination to the combination lock will then be able to rotate a dial of the lock wherein bolt 158 is retracted from the first position to the second position and the latch is free to rotate into the unlocked position.

In accordance with an exemplary embodiment of the present invention the latch rotates in a first plane 235 of rotation while the bolt slides in a second plane 237. In one exemplary embodiment, the first plane of rotation is perpendicular to the second plane. In alternative exemplary embodiments, the planes may be other non-equal locations other than perpendicular to each other.

In accordance with this embodiment of the present invention, the lock is provided with a locking mechanism or anti-locking mechanism 176. However and as mentioned above and as illustrated in at least FIGS. 34A and 34B, the lock 110 and locking mechanism 120 constructed without locking mechanism or anti-locking mechanism 176.

Figures 24A, 24B, 24C, 24D:
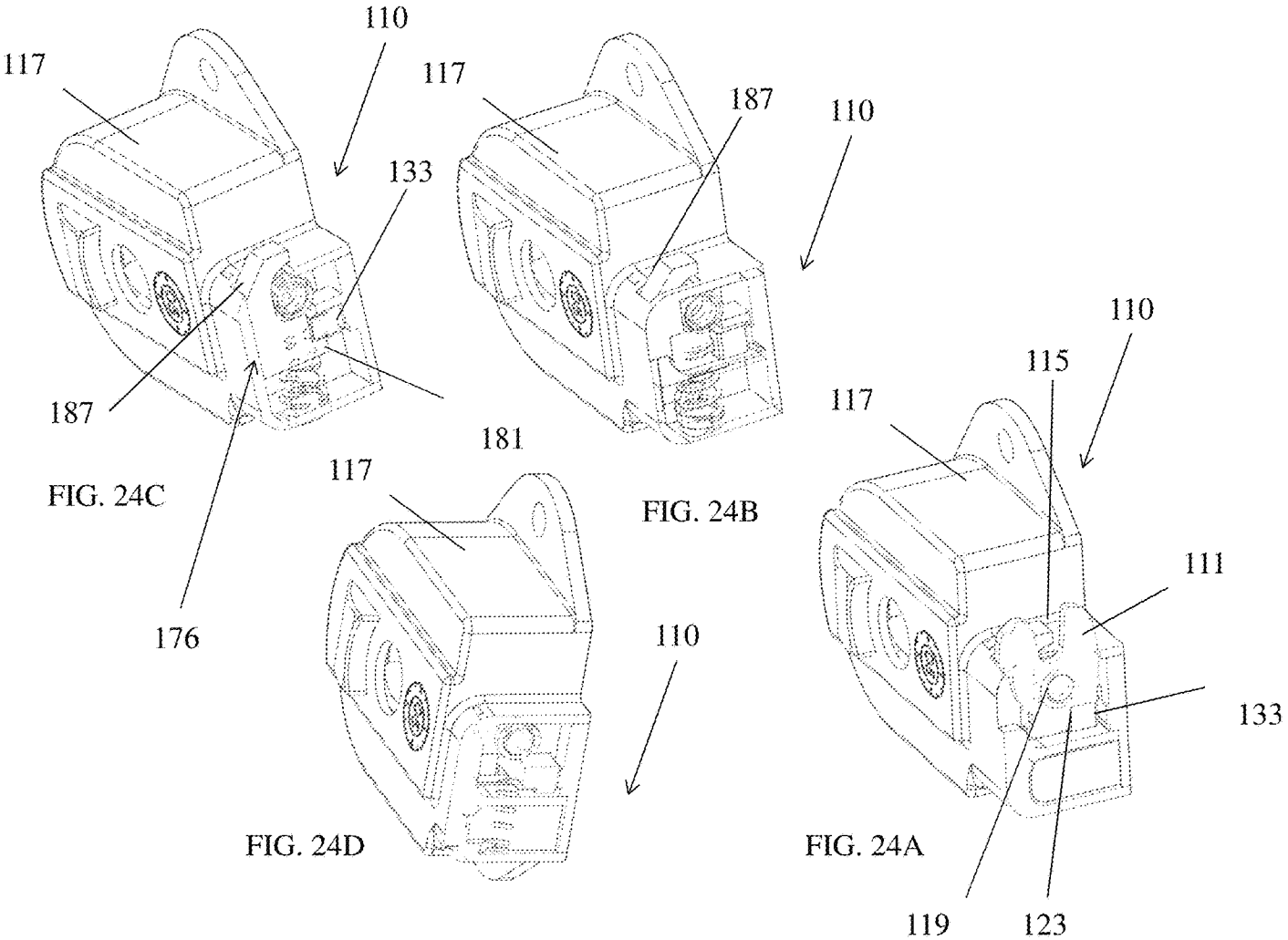
Figure 24E:
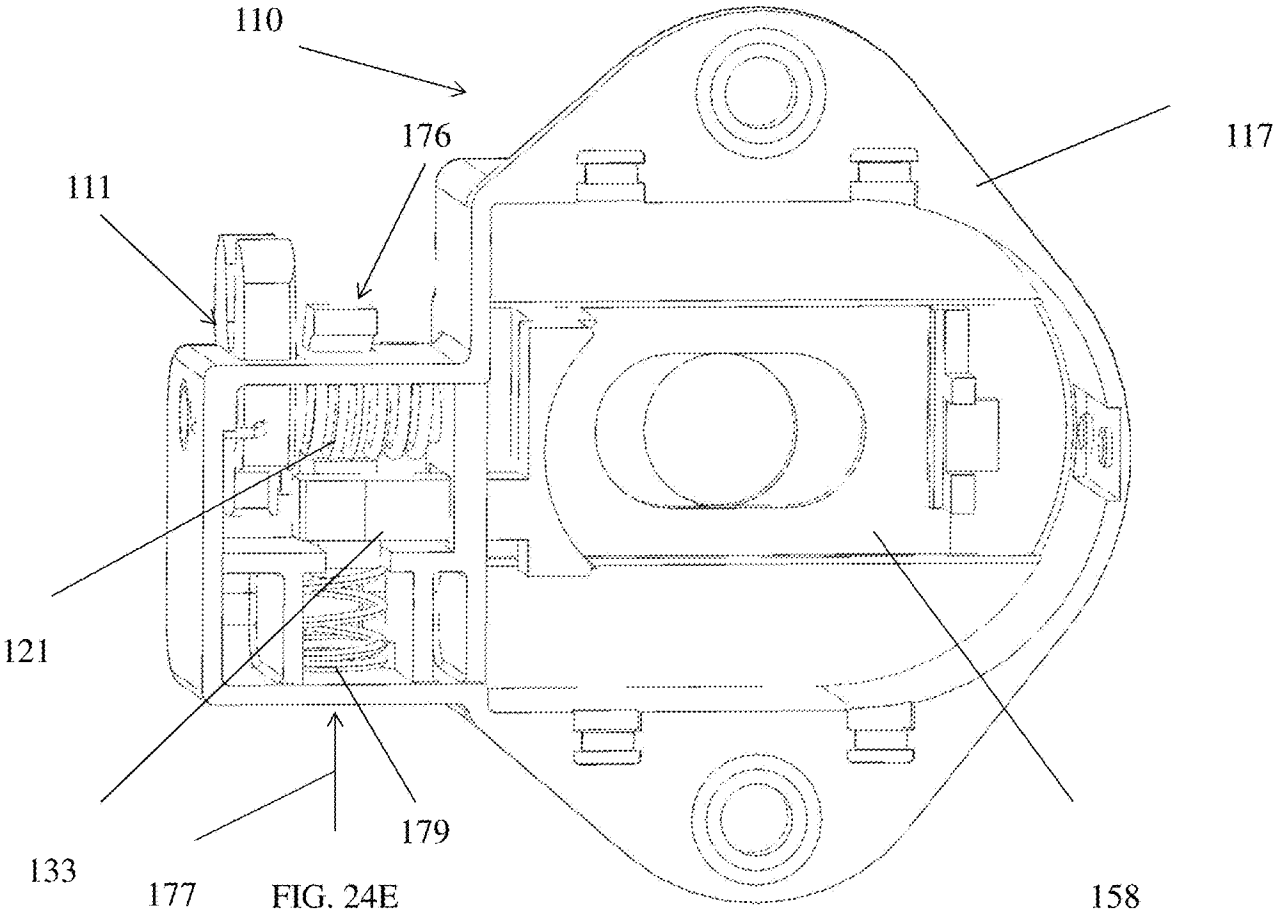
Figure 25E:
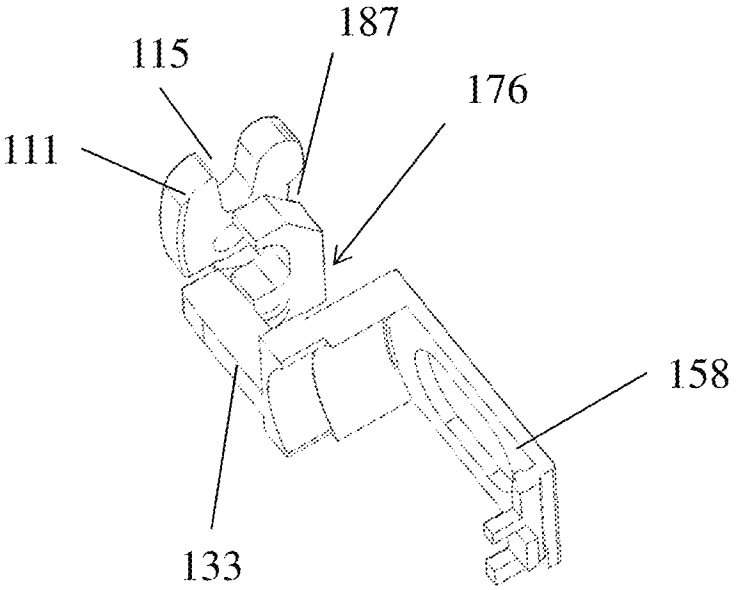
Figure 25D:
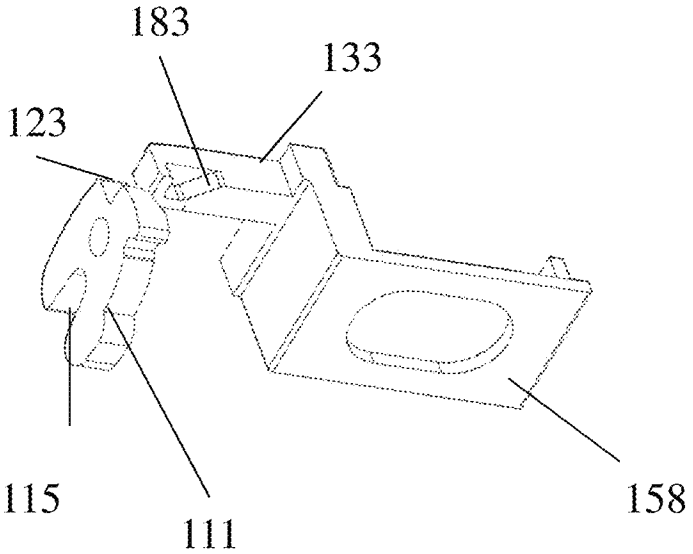
Figure 29A:
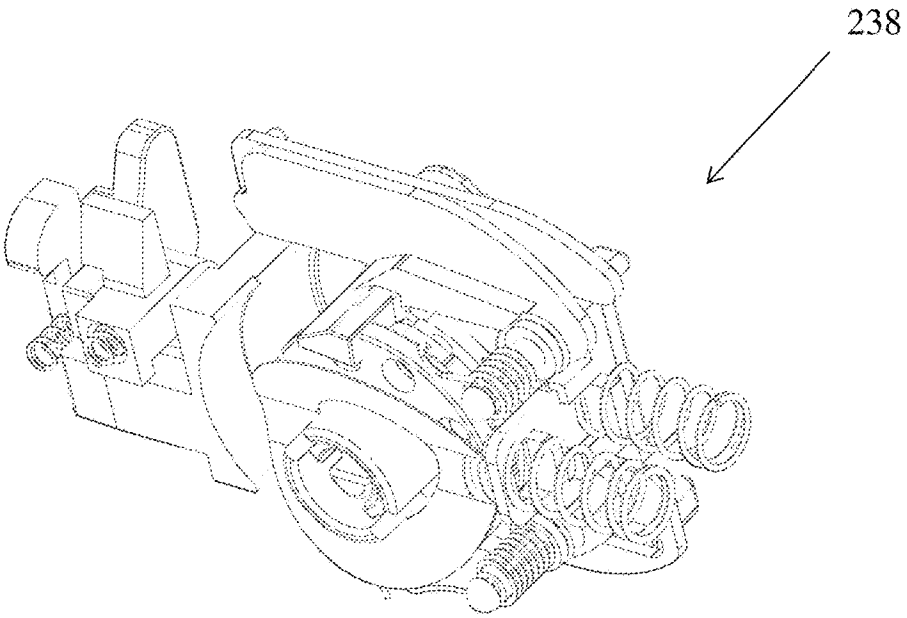
FIGS. 29A-32B are various views illustrating the combination lock mechanism of the lock in accordance an embodiment of the present invention.
Figure 29B:
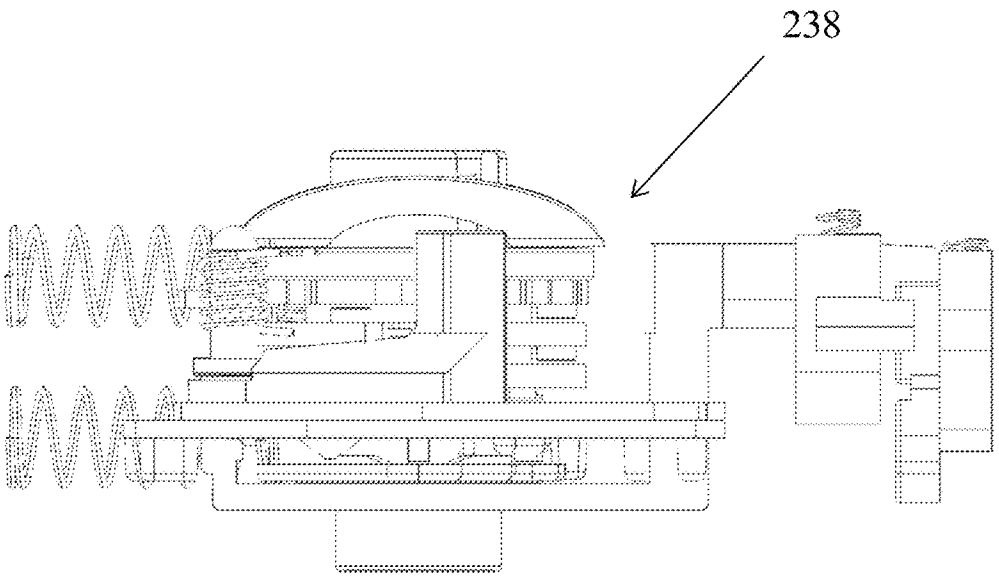
Figure 29C:
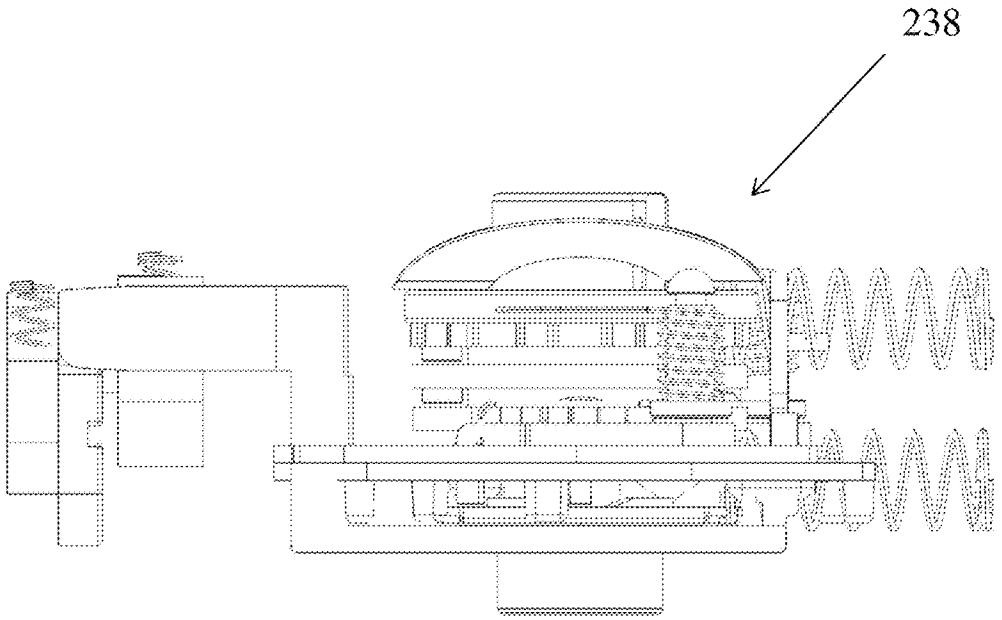
Figure 30C:
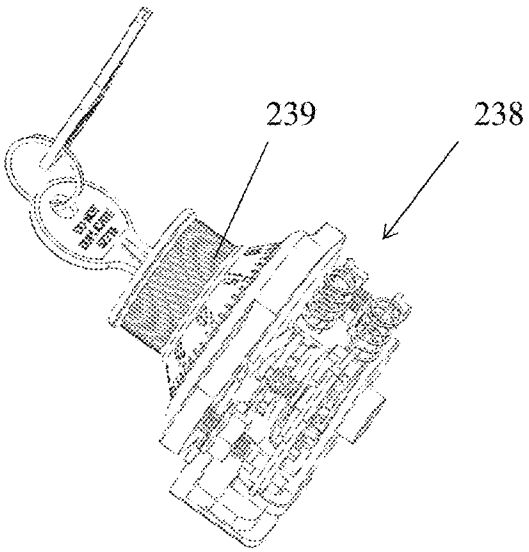
Figure 30A:
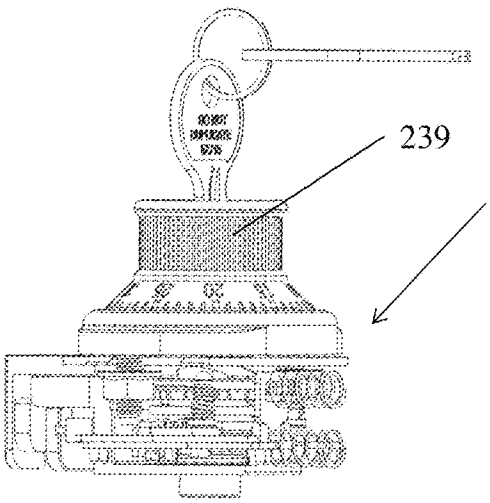
Figure 30B:
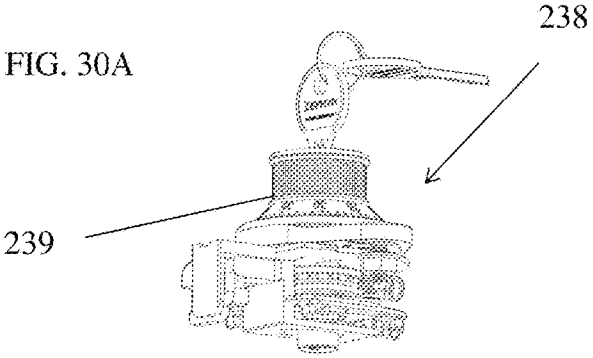
Figure 31B:
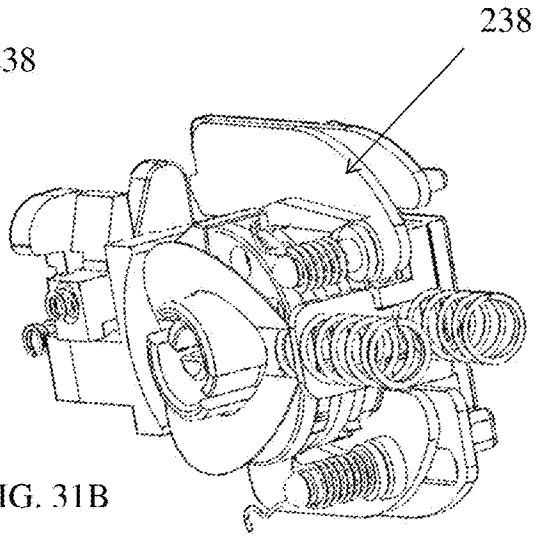
Figure 31A:
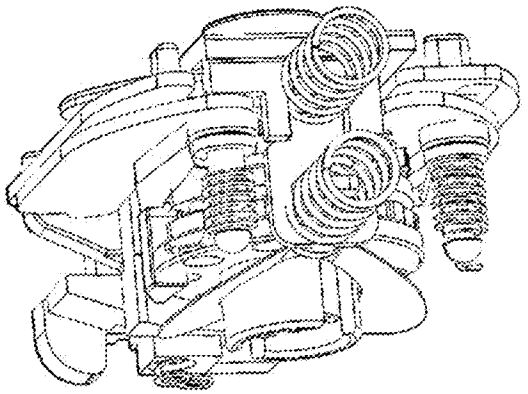

Locking mechanism or anti-locking mechanism 176 is configured for movement between an unlocking position (See at least FIG. 24E wherein the bolt is prevented from sliding into the first position and thus engaging the rotary latch) and a locking position (See at least FIG. 24A wherein the bolt is allowed to slide into the first position and engage or lock the rotary latch into the locking position). The locking mechanism 176 is spring biased upwardly into the unlocking position in a first direction 177 by a spring 179. In order to move the locking mechanism 176 into the locking position the biasing force of spring 179 must be overcome such that the locking mechanism will move in a second direction opposite to direction 176.

As illustrated in FIGS. 26A-27B, the locking mechanism 176 has a feature 181 configured to engage a corresponding feature or opening 183 of portion 133 of bolt 158 such that when the locking mechanism 176 is in the unlocking position the bolt 158 is prevented from sliding into engagement with the rotary latch 111 since feature 181 will engage feature opening 183. In order to move the locking mechanism 176 into the locking position such that the bolt removed into engagement with the rotary latch 111 a chamfered or angled surface 187 is provided such that as the door the lock is secured to is closed within a door frame, the angled surface 187 will make contact with a portion of the frame or the striker and thus force the locking mechanism 176 in a direction opposite to arrow 177 such that feature 181 no longer engages feature 183 of the bolt 158 and bolt 158 is now allowed to move into engagement with the rotary latch such that as the rotary latch 111 rotates into the locking position the portion 133 of the rotary latch 111 will engage the notch 123. Locking or anti-locking mechanism 176 further comprises a feature 189 configured to engage a portion of spring 179.

By including the locking mechanism 176 into lock 110, locking mechanism or anti-locking mechanism 176 must be first moved from the unlocking position into the locking position such that bolt 158 may move into locking engagement with the rotary latch 111. Locking mechanism 176 is configured to have surface 187 positioned to engage a portion of the striker or frame of the locker or door frame the lock is used with. This will prevent inadvertent locking of the rotary latch 111 since rotation of the rotary latch into the locking position will not cause the same to remain in the locked position since the bolt will not be moved into engagement with the rotary latch unless the locking mechanism 176 is moved from the unlocking position to the locking position by overcoming the biasing force of spring 179. Accordingly, locking mechanism 176 is moved into the locking position as the door is closed and a portion of the locker or door frame or striker engages a surface 187 pushes it downwardly and removes feature 181 out of engagement with opening 183 such that bolt 158 can slide into engagement with the rotary latch 111 as its rotated into the locking position as it engages a striker at the same time locking mechanism 176 is pushed downwardly against the biasing force of spring 179. Accordingly, this embodiment includes a rotary latch 111 that works in conjunction with a locking mechanism or anti-locking mechanism 176 that must be manipulated in order to allow the rotary latch 111 to move into engagement with portion 133 of bolt 158.

In general and with non-limiting reference to the previous embodiments, operation of a non-limiting lock mechanism configured for moving the bolt of the various embodiments is described. Of course, other locking mechanisms are considered to be within the scope of exemplary embodiments of the present invention. For simplicity and in one non-limiting embodiment, the lock is described herein as a three-digit combination lock of course other variations are contemplated to be within the scope of exemplary embodiments of the present invention including but not limited to key operated locks as well as combination locks and/or combinations thereof. Of course and as other applications require, lock having more or less than three-digits is considered within the scope of the present invention.

The lock includes a keyed locking cylinder secured in a dial. The locking cylinder is actuatable by a master key such that rotation of the key retracts bolt, thus opening lock by allowing the latch to rotate or move into the unlocked position. Accordingly, lock is openable by both a combination and a master key. For example and in a school application, a student assigned to a locker having lock is provided with the combination of the lock for opening the lock, while the supervisory authorities of the school maintain the key for opening the lock as needed.

Further, the keyed locking cylinder also includes a mating portion adapted to mate with a corresponding mating portion of the button. The locking cylinder is actuatable by a master key such that rotation of the key, along with simultaneous depression of the button changes the combination of lock wherein a combination plate is able to be rotated to a different position thus, changing the combination of the lock. Accordingly, the combination of lock is changeable by, for example, the supervisory authorities of the school as needed, but not by the student assigned to locker having the lock thereon.

The locking cylinder is prevented from rotating during rotation of the dial by a locking cylinder retainer. More specifically, the retainer includes a pair of arms adapted to mate with the locking cylinder to prevent rotation of the locking cylinder.

The retainer is connected to a tumbler disc shaft that extends away from the locking cylinder. A clutch plate is interconnected with the tumbler disc shaft through the combination plate. Clutch plate includes ten peripheral notches and combination plate includes a plurality of holes disposed therein. Each hole corresponds to a different combination of lock, thus providing lock with multiple possible combinations.

The tumbler disc shaft includes a plurality of notched disks rotatably disposed thereon. The notched disks, each include notches configured to engage a spring biased drive lever pivotally biased by springs towards the tumbler disc shaft and the notched disks. By rotating the dial right, then left and then right according to the correct combination each notched disk is independently rotated and stopped at a point where all of the notches of the disks align with the drive lever and a portion of the same is received within the notches of the aligned notch disks such that further rotation of the dial in the same direction as the last rotation will cause a force to be applied to the bolt such that the same is retracted into cavity as a biasing force of a spring urging the bolt into engagement with the latch is overcome.

Conversely, when the drive lever is no longer received within the notches of the notched disks a spring acts to extend bolt back into cavity and when the latch moved the bolt engages a portion of the latch thus locking the lock. As mentioned above, examples of such a combination lock mechanism are found in at least U.S. Pat. Nos. 3,023,600, 3,023,602, 3,031,876, 3,031,877, and 3,190,089 to Foote et al., the contents each of which are incorporated herein by reference thereto.

FIGS. 29A-32B are various views illustrating a combination lock mechanism 238 of the lock which can be used in accordance the numerous embodiments disclosed herein. FIGS. 29A-32B are partial views of the lock so that components of combination lock mechanism 238 are capable of being viewed. As mentioned, above actuation of the combination lock mechanism 238 via rotation of dial 239 allows a user to cause a force to be applied to the bolt such that the same is retracted away from its locking engagement of blocking position as a biasing force of a spring urging the bolt into engagement with the latch is overcome.

Figure 32B:
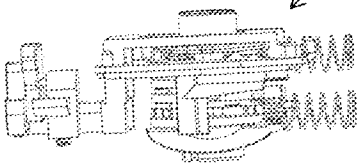
Figure 32A:
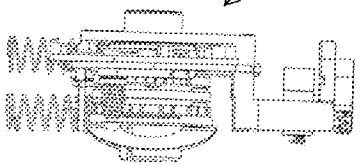
FIGS. 32C and 32D are exploded views of a lock according to one non-limiting exemplary embodiment of the present invention.
Figure 32D:
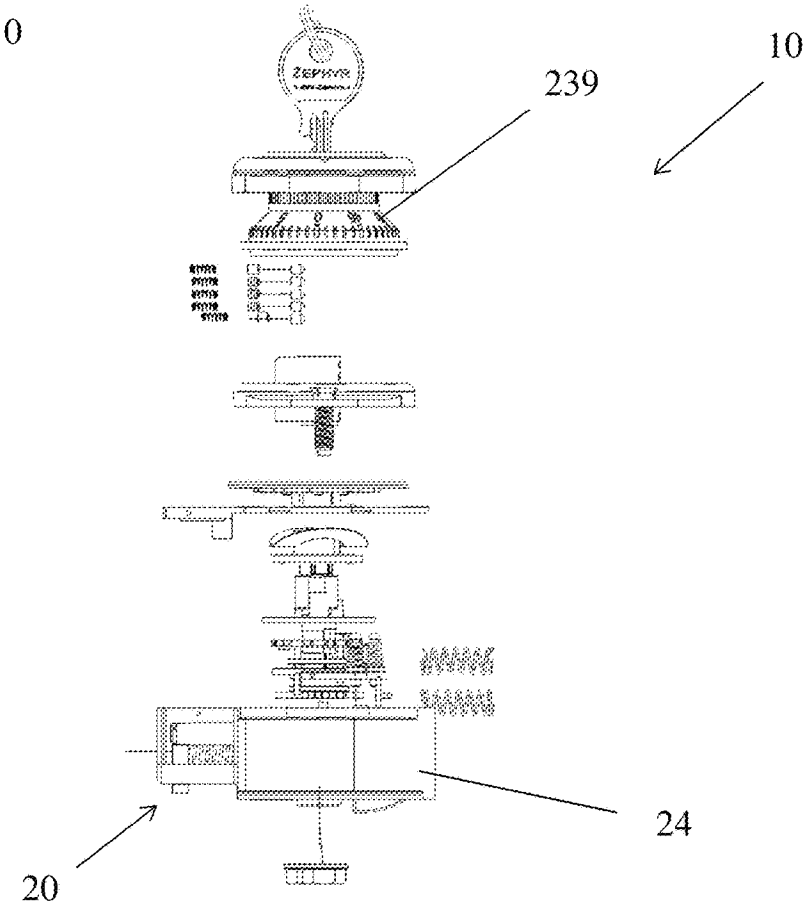
Figure 32C:
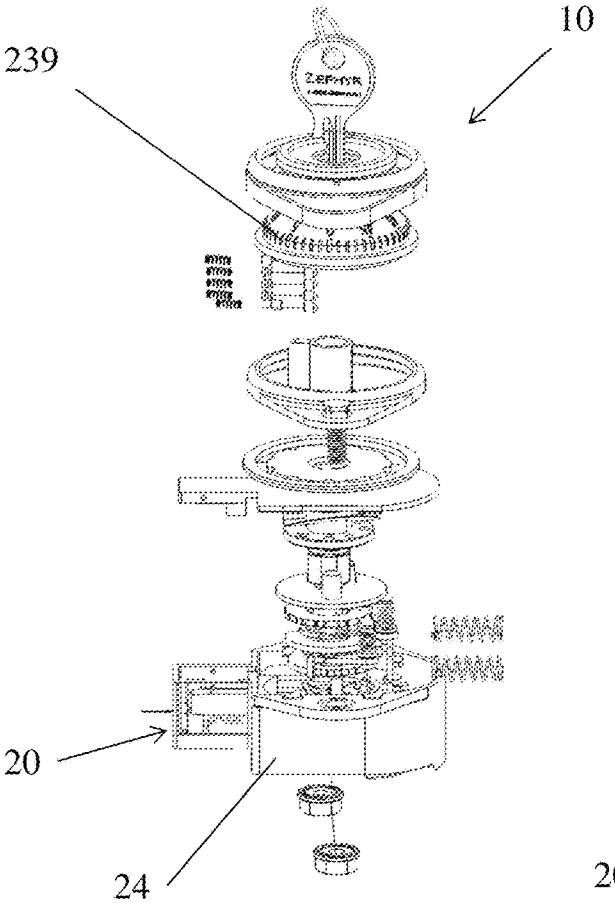
Figure 33B:
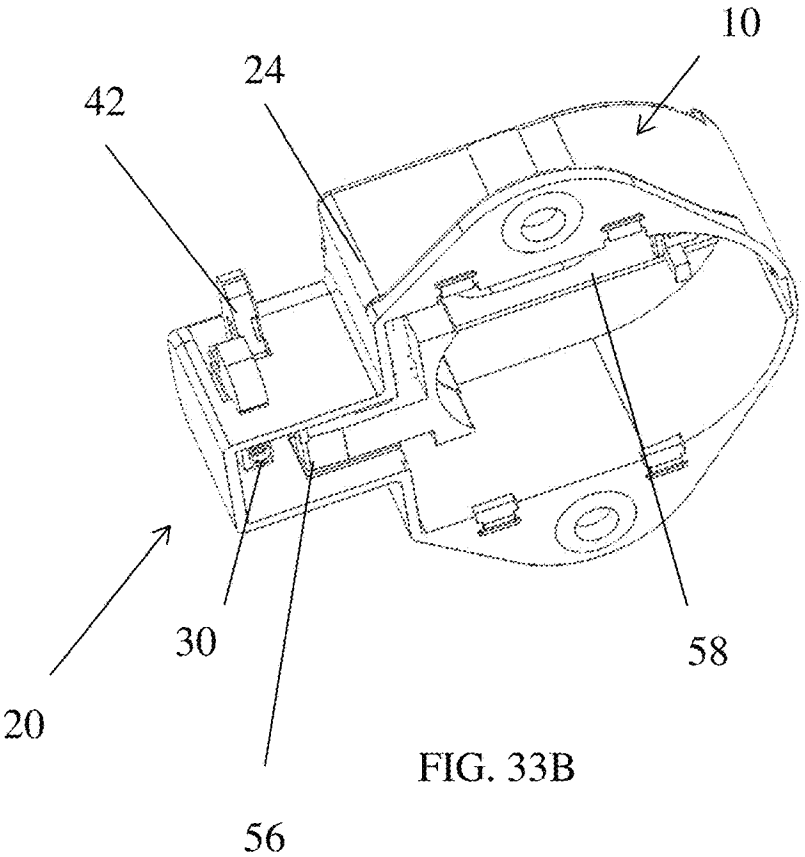
FIGS. 33A-34B illustrate still other alternative embodiments of the present invention.
Figure 33A:
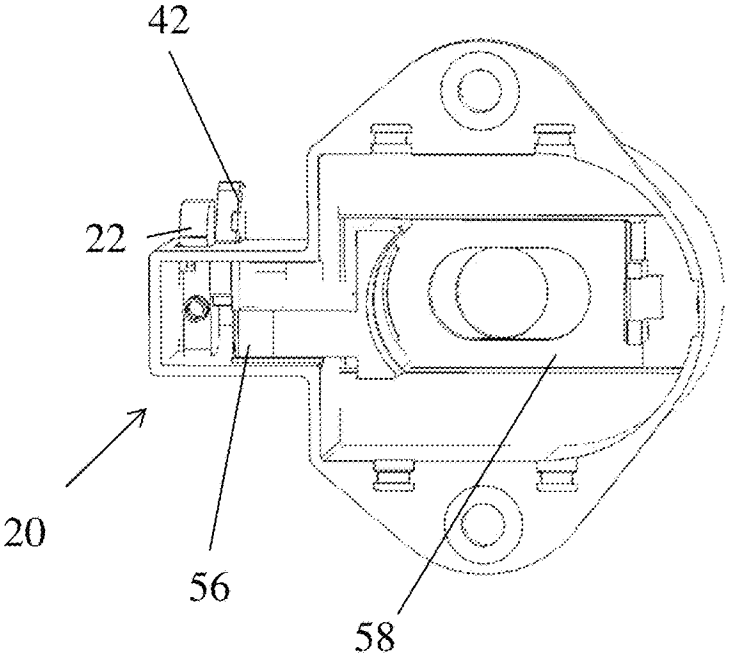
Figure 33C:
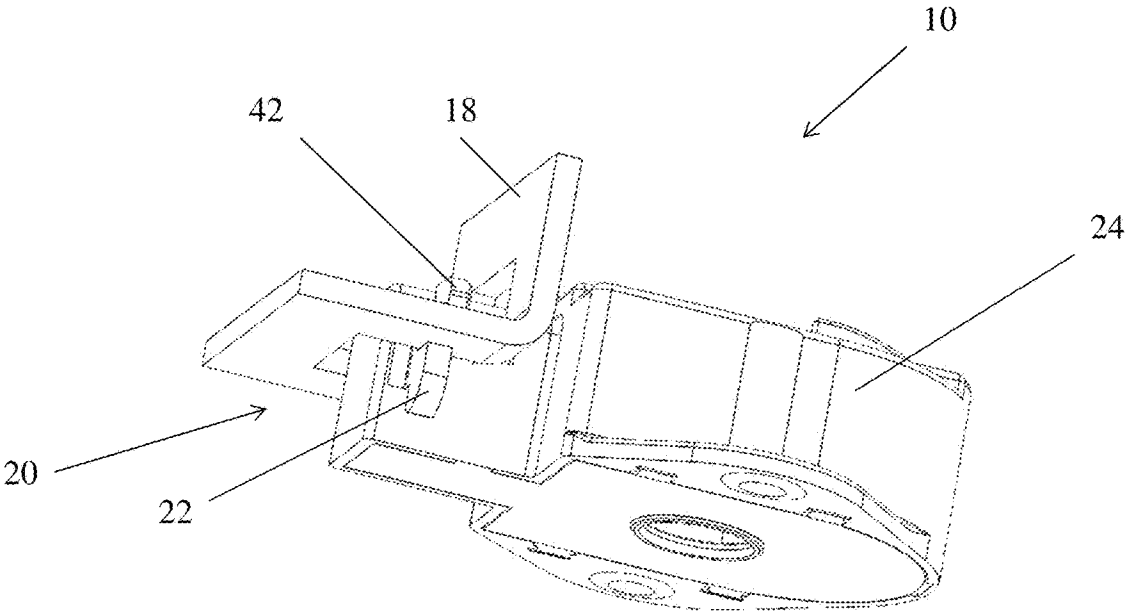
Figure 33E:
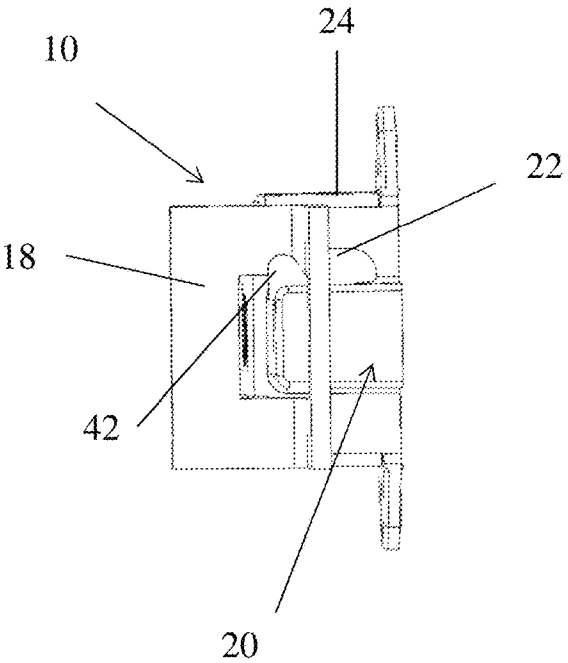
Figure 33D:
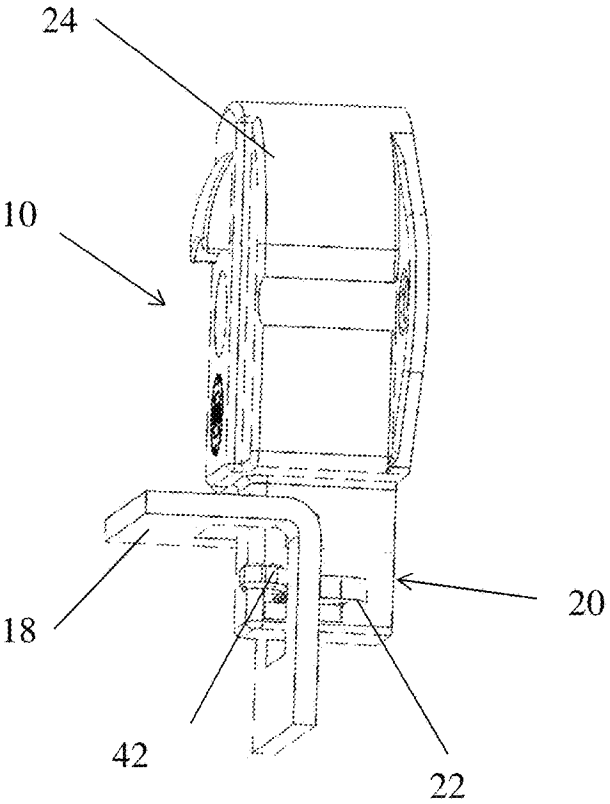
Figure 34B:
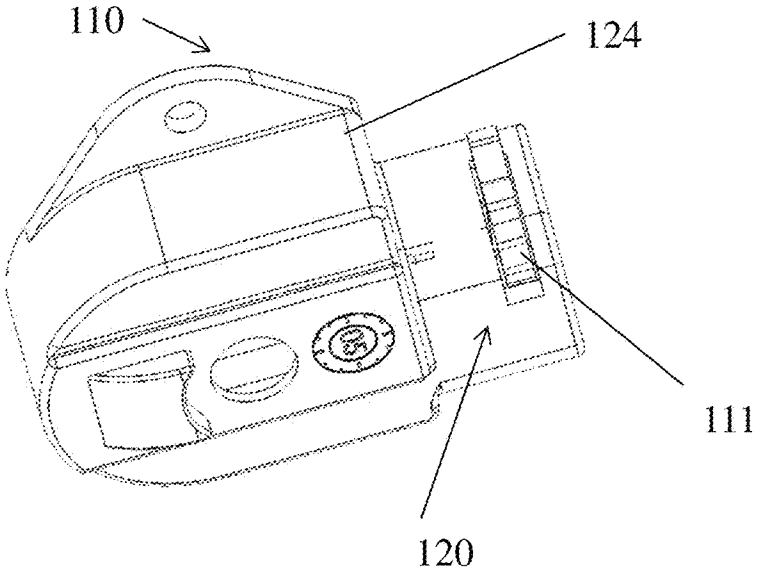
Figure 34A:
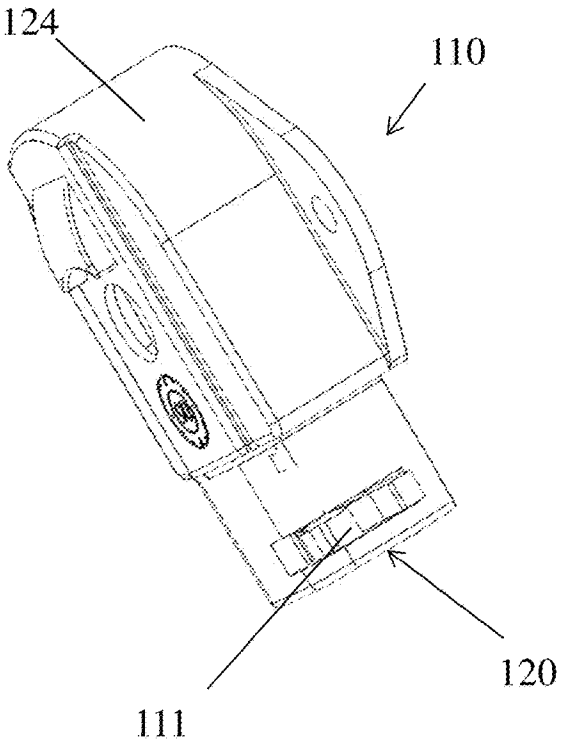

FIGS. 32C and 32D are exploded views of a lock 10 accordingly to one non-limiting exemplary embodiment of the present invention.

Accordingly numerous exemplary embodiments of a lock and associated locking mechanism are disclosed herein wherein and in one non-limiting embodiment, the locking mechanism has a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position and thus capture a striker therebetween.

Figure 35B:
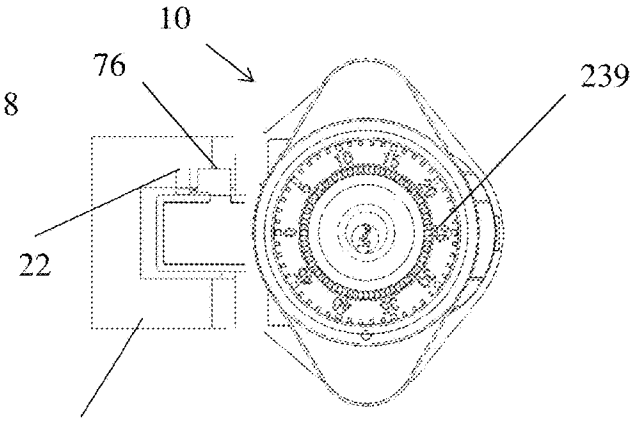
FIGS. 35A-35C are front and back views of a lock in accordance with one non-limiting exemplary embodiment of the present invention illustrating the lock secured to a striker plate.
Figure 35A:
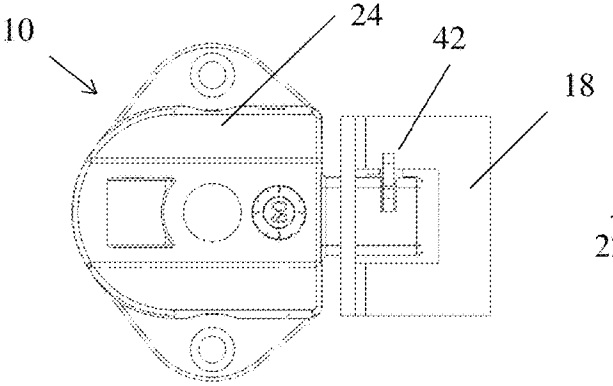
Figure 35C:
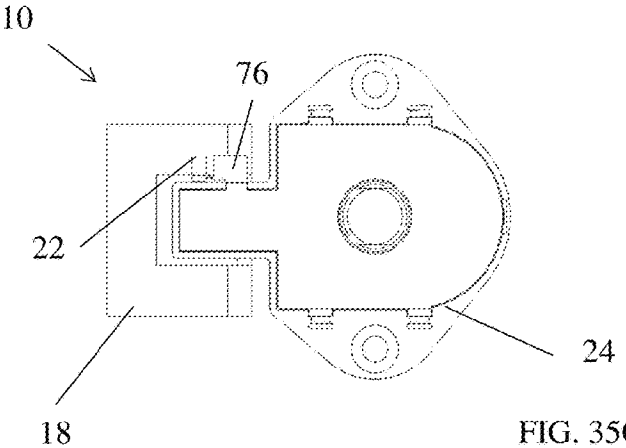

FIGS. 35A-35C are front and back views of a lock 10 in accordance with one non-limiting exemplary embodiment of the present invention illustrating the lock secured to a striker plate 18. As mentioned above, lock 10 can be constructed with or without locking mechanism 76.

It should also be noted that the terms "first", "second", and "third", and the like may be used herein to modify elements performing similar and/or analogous functions. These modifiers do not imply a spatial, sequential, or hierarchical order to the modified elements unless specifically stated.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position and wherein linear movement of the first member in a first plane will cause linear movement of the second member in a second plane, the second plane being different from the first plane, wherein horizontal movement of the first member in the first plane will cause vertical movement of the second member in the second plane; and a bolt configured for movement between a blocking position and an unblocking position, the bolt preventing the second member from moving from the second position to the first position when the bolt is in the blocking position.

2. The lock as in claim 1, wherein the first member and the second member are configured to define opposite ends of a receiving area when the first member is in the second position and the second member is in the second position.

3. The lock as in claim 1, wherein the bolt is moved between its respective first and second position by a combination lock.

4. The lock as in claim 3, wherein the combination lock is a key-controlled combination changing permutation lock.

5. The lock as in claim 1, further comprising a locking member slidably mounted to the housing for movement between a first position and a second position, wherein the locking member prevents the bolt from moving to the blocking position from the unblocking position when the locking member is in the first position.

6. The lock as in claim 5, wherein the first member further comprises a channel configured to slidably engaged an elongated surface of the housing as the first member moves between the first position and the second position and wherein the second member further comprises a channel configured to slidably engage another elongated surface of the housing as the second member moves between the first position and the second position and wherein the first member further comprises a protrusion configured for slidable movement within an elongated opening of the second member, wherein the elongated opening of the second member is configured such that movement of the first member between the first and second positions will cause movement of the second member between its first and second positions due to the slidable movement of the protrusion within the opening and wherein the locking member is configured to allow a feature of the bolt to pass through an opening in the locking member when the locking member is in the second position and wherein the locking member is configured to prevent the feature of the bolt to move through the opening in the locking member when the locking member is in the first position.

7. The lock as in claim 6, wherein the first member and the locking member move in the first plane as they move between their respective first position and second position and wherein the second member moves in the second plane as the second member moves between its first position and second position.

8. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position; and a bolt configured for movement between a blocking position and an unblocking position, the bolt preventing the second member from moving from the second position to the first position when the bolt is in the blocking position, wherein the first member further comprises a protrusion configured for slidable movement within an elongated opening of the second member, wherein the elongated opening of the second member is configured such that movement of the first member between the first and second positions will cause movement of the second member between its first and second positions due to the slidable movement of the protrusion within the opening.

9. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position;

a bolt configured for movement between a blocking position and an unblocking position, the bolt preventing the second member from moving from the second position to the first position when the bolt is in the blocking position; and a locking member slidably mounted to the housing for movement between a first position and a second position, wherein the locking member prevents the bolt from moving to the blocking position from the unblocking position when the locking member is in the first position, wherein the first member and the locking member move in a first plane as they move between their respective first position and second position and wherein the second member moves in a second plane as the second member moves between its first position and second position, wherein the first plane is different from the second plane, and wherein horizontal movement of the first member in the first plane will cause vertical movement of the second member in the second plane.

10. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position;

a bolt configured for movement between a blocking position and an unblocking position, the bolt preventing the second member from moving from the second position to the first position when the bolt is in the blocking position; and a locking member slidably mounted to the housing for movement between a first position and a second position, wherein the locking member prevents the bolt from moving to the blocking position from the unblocking position when the locking member is in the first position, wherein the first member and the locking member move in a first plane as they move between their respective first position and second position and wherein the second member moves in a second plane as the second member moves between its first position and second position, wherein the second member moves vertically in the second plane as the first member moves horizontally in the first plane.

11. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position; and a bolt configured for movement between a blocking position and an unblocking position, the bolt preventing the second member from moving from the second position to the first position when the bolt is in the blocking position, wherein neither the first member nor the second member move rotationally with respect to the housing as the first member and the second member transition between their respective first and second positions, and wherein horizontal movement of the first member will cause vertical movement of the second member.

12. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position; and a bolt configured for linear movement between a blocking position and an unblocking position, the bolt preventing the second member from moving from the second position to the first position when the bolt is in the blocking position, wherein a contact surface of the first member and a contact surface the second member are configured to define opposite ends of a receiving area when the first member is in the second position and the second member is in the second position, wherein the contact surface of the second member is an inclined surface and the contact surface of the first member is a vertical surface, and wherein horizontal movement of the first member will cause vertical movement of the second member.

13. A lock, comprising:

a lock mechanism having a first member and a second member, the first member and the second member each being slidably mounted to a housing of the lock, wherein the first member is capable of movement between a first position and a second position and the second member is capable of movement between a first position and a second position and wherein movement of the first member from the first position to the second position causes the second member to move from the first position to the second position; and a bolt configured for movement between a blocking position and an unblocking position, the bolt preventing the second member from moving from the second position to the first position when the bolt is in the blocking position, wherein the first member further comprises a channel configured to slidably engaged an elongated surface of the housing as the first member moves between the first position and the second position and wherein the second member further comprises a channel configured to slidably engage another elongated surface of the housing as the second member moves between the first position and the second position, and wherein horizontal movement of the first member will cause vertical movement of the second member.

14. The lock as in claim 13, wherein the first member further comprises a protrusion configured for slidable movement within an elongated opening of the second member, wherein the elongated opening of the second member is configured such that movement of the first member between the first and second positions will cause movement of the second member between its first and second positions due to the slidable movement of the protrusion within the opening.

15. The lock as in claim 14, wherein the locking member is configured to allow a feature of the bolt to pass through an opening in the locking member when the locking member is in the second position and wherein the locking member is configured to prevent the feature of the bolt to move through the opening in the locking member when the locking member is in the first position.

16. A method of locking and unlocking a lock, the method comprising:

biasing a first member of a lock mechanism into a first position;

coupling the first member to a second member of the lock mechanism, wherein linear movement of the first member in a first plane from the first position to a second position will cause linear movement of the second member in a second plane from a first position to a second position wherein horizontal movement of the first member in the first plane will cause vertical movement of the second member in the second plane; and preventing the second member to move from the second position to the first position by moving a feature of a bolt into a blocking position with respect to a surface of the second member when the second member is in the second position.

17. The method as in claim 16, further comprising the step of preventing the feature of the bolt from moving into the blocking position by engaging a portion of the bolt by a locking member movably mounted to the housing, wherein the locking member prevents movement of the feature of the bolt into the blocking position when the locking member is in a first position and wherein the locking member allows movement of the feature of the bolt into the blocking position when the locking member is in a second position.

18. A method of locking and unlocking a lock, the method comprising:

biasing a first member of a lock mechanism into a first position;

coupling the first member to a second member of the lock mechanism, wherein movement of the first member from the first position to a second position will cause the second member to move from a first position to a second position wherein a portion of the second mechanism will be extended from a housing of the lock; and preventing the second member to move from the second position to the first position by moving a feature of a bolt into a blocking position with respect to a surface of the second member when the second member is in the second position, wherein the locking member is spring biased into the first position and movement of the first member and the locking member from their respective first positions to their respective second positions occurs in parallel planes and movement of the second member to the second position occurs in a plane that is perpendicular to a plane of movement of the first member and wherein the first member further comprises a protrusion configured to be slidably received within an opening of the second member.

* * * * *